US009946193B2

(12) United States Patent
Jimba et al.

(10) Patent No.: US 9,946,193 B2
(45) Date of Patent: Apr. 17, 2018

(54) DEVELOPER SUPPLY CONTAINER AND DEVELOPER SUPPLYING SYSTEM

(71) Applicant: CANON KABUSHIKI KAISHA, Tokyo (JP)

(72) Inventors: Manabu Jimba, Toride (JP); Yusuke Yamada, Toride (JP); Ayatomo Okino, Moriya (JP); Nobuyuki Yomoda, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/245,342

(22) Filed: Aug. 24, 2016

(65) Prior Publication Data

US 2017/0060028 A1 Mar. 2, 2017

(30) Foreign Application Priority Data

Aug. 27, 2015 (JP) ..... 2015-167525

(51) Int. Cl.
*G03G 15/08* (2006.01)

(52) U.S. Cl.
CPC ..... *G03G 15/0877* (2013.01); *G03G 15/0872* (2013.01); *G03G 15/0881* (2013.01); *G03G 15/0886* (2013.01)

(58) Field of Classification Search
USPC ..... 399/119, 120, 252–263
See application file for complete search history.

(56) References Cited

U.S. PATENT DOCUMENTS 5,909,609 A * 6/1999 Yahata ..... G03G 15/0822 399/258
6,879,789 B2 4/2005 Yamada et al.
(Continued)

FOREIGN PATENT DOCUMENTS

EP 2 837 973 A1 2/2015
JP H1061792 A 3/1998
(Continued)

OTHER PUBLICATIONS

Nobuyuki Yomoda et al., U.S. Appl. No. 15/226,141, filed Aug. 2, 2016.
(Continued)

*Primary Examiner* — Hoan Tran
(74) *Attorney, Agent, or Firm* — Fitzpatrick, Cella, Harper & Scinto

(57) ABSTRACT

A developer supply container includes a developer accommodating portion capable of accommodating a developer, a storage capable of storing the developer, with the storage being provided with a discharge opening configured to permit discharge of the developer from the storage, and a pump portion changeable between a maximum volume state and a minimum volume state and actable to the discharge opening. In addition, a discharge suppressing portion is movable between a first position in which the discharge suppressing portion is remote from the discharge opening and a second position in which the discharge suppressing portion is close to the discharge opening, wherein the discharge suppressing portion is in the second position at least for a predetermined period of time when the pump portion is in the minimum volume state.

14 Claims, 19 Drawing Sheets

(56) References Cited

U.S. PATENT DOCUMENTS

| | | | | |
|---|---|---|---|---|
| 6,934,494 | B2 | 8/2005 | Yamada et al. | |
| 6,963,713 | B2 | 11/2005 | Isomura et al. | |
| 6,985,686 | B2 | 1/2006 | Okino et al. | |
| 6,990,301 | B2 | 1/2006 | Yamada et al. | |
| 7,039,347 | B2 | 5/2006 | Yamada et al. | |
| 7,079,788 | B2 | 7/2006 | Ban et al. | |
| 7,386,251 | B2 | 6/2008 | Yamada et al. | |
| 7,433,634 | B2 | 10/2008 | Okino et al. | |
| 7,574,162 | B2 * | 8/2009 | Yamane | G03G 21/206 399/258 |
| 8,565,649 | B2 | 10/2013 | Murakami et al. | |
| 8,909,094 | B2 | 12/2014 | Yamada et al. | |
| 9,046,820 | B1 | 6/2015 | Yamada et al. | |
| 9,213,262 | B2 | 12/2015 | Nagashima et al. | |
| 9,229,364 | B2 | 1/2016 | Murakami et al. | |
| 9,229,368 | B2 | 1/2016 | Okino et al. | |
| 9,354,550 | B2 | 5/2016 | Murakami et al. | |
| 9,354,551 | B2 | 5/2016 | Murakami et al. | |
| 9,389,538 | B2 * | 7/2016 | Nakajima | G03G 15/0877 |
| 2003/0235435 | A1 | 12/2003 | Muramatsu et al. | |
| 2012/0014713 | A1 | 1/2012 | Murakami et al. | |
| 2012/0014722 | A1 | 1/2012 | Okino et al. | |
| 2013/0209134 | A1 | 8/2013 | Okino et al. | |
| 2014/0016967 | A1 | 1/2014 | Murakami et al. | |
| 2014/0153974 | A1 | 6/2014 | Jimba et al. | |
| 2014/0233986 | A1 | 8/2014 | Murakami et al. | |
| 2015/0277285 | A1 | 10/2015 | Okino et al. | |
| 2016/0070202 | A1 | 3/2016 | Murakami et al. | |
| 2016/0124348 | A1 | 5/2016 | Yamada et al. | |
| 2016/0131994 | A1 | 5/2016 | Murakami et al. | |

FOREIGN PATENT DOCUMENTS

| | | | |
|---|---|---|---|
| JP | 2008-309858 | A | 12/2008 |
| JP | 2010-256893 | A | 11/2010 |
| JP | 2010-256894 | A | 11/2010 |
| JP | 2013-167767 | A | 8/2013 |
| JP | 2014-202782 | A | 10/2014 |

OTHER PUBLICATIONS

European Search Report dated Jan. 19, 2017, in related European Patent Application No. 16184452.7.

* cited by examiner (a)

(b)

(c)

(a)

(b)

(c)

(a)

(b)

(a)

(b)

(a)

(b)

(a)

(b)

DEVELOPER SUPPLY CONTAINER AND DEVELOPER SUPPLYING SYSTEM

FIELD OF THE INVENTION AND RELATED ART

The present invention relates to a developer supply container detachably mountable to a developer supplying apparatus and a developer supplying system. The developer supply container is used with an image forming apparatus such as a copying machine, a facsimile machine, a printer or a complex machine having functions of a plurality of such machines.

Conventionally, an image forming apparatus such as an electrophotographic copying machine uses a developer of fine particles. In such an image forming apparatus, the developer is supplied from the developer supply container in response to consumption thereof resulting from an image forming operation. Such a developer supply container is disclosed in Japanese Laid-open Patent Application 2010-256894, for example.

The apparatus disclosed in Japanese Laid-open Patent Application 2010-256894 employs a system in which the developer is discharged using a bellow pump provided in the developer supply container. More particularly, the bellow pump is expanded to provide a pressure lower than the ambient pressure in the developer supply container, so that the air is taken into the developer supply container to fluidize the developer (first step). Then, the bellow pump is contracted to provide a pressure higher than the ambient pressure in the developer supply container, so that the developer is pushed out by the pressure difference between the inside and the outside of the developer supply container, thus discharging the developer (second step). By repeating the two steps alternately, the developer is stably discharged.

In the developer supply container of Japanese Laid-open Patent Application 2008-309858, a reciprocation member is provided and is reciprocable in a discharging passage extending from the developer supply container to a discharge opening for discharging the developer externally.

Above-discussed developer supply container of Japanese Laid-open Patent Application 2010-256894 produces a pressure difference between the inside and the outside of the developer supply container between the total volume of the developer supply container, using a bellow pump. With such a structure, in order to assuredly loosen the developer which is compacted in a developer storage portion provided adjacent to the discharge opening in the developer supply container during the transportation, for example, and discharged developer in a stabilized state, it will be required that the pressure difference between the inside and the outside of the developer accommodating portion of the developer supply container is relatively large. For this reason, it has been desirable to increase the stroke of the expansion-contraction of the bellow pump or to increase the inside volume of the bellow pump.

If the expansion-contraction stroke of the bellow pump is increased, the developer supply container upsized, and therefore, the space occupied by the developer supply container in the main assembly of the image forming apparatus increases. The expansion-contraction stroke and the inside volume of the bellow pump required for fluidizing compacted developer are excessive as compared with those required for discharging the developer in the normal state (sufficiently fluidized developer). Therefore, when such a bellow pump is operated in the normal state, it may be required to provide a structure for releasing the air to be discharged to the image forming apparatus side. Therefore, the upsizing and/or cost increase of the image forming apparatus or the developer supply container may result.

In addition, there is a likelihood that the accuracy of the developer discharge amount decreases more than expected, due to the variation in the pressure difference between the inside and outside of the developer supply container produced by the expansion and contraction of the bellow pump or in the expanding-and-contracting operation of the bellow pump. Or, there is a likelihood the accuracy of the developer discharge amount decreases more than expected, due to the variation in the timing at which the air is discharged through the discharge opening together with the developer by the expansion and contraction of the bellow pump.

If the reciprocation member of the developer supply container disclosed in Japanese Laid-open Patent Application 2008-309858 were provided in the developer supply container of Japanese Laid-open Patent Application 2010-256894, the developer compacted by the transportation could be loosened without changing the stroke of the expansion and contraction of the bellow pump. However, the deterioration of the accuracy of the developer discharge amount could not be avoided.

Accordingly, it is an object of the present invention to provide an developer supply container and a developer supplying system with which the accuracy of the developer discharge amount through the discharge opening is improved.

According to an aspect of the present invention, there is provided a developer supply container comprising a developer accommodating portion capable of accommodating a developer; a storage portion capable of storing the developer; said storage portion being provided with a discharge opening configured to permit discharge of the developer from said storage portion; a pump portion changeable between a maximum volume state and a minimum volume state and actable to said discharge opening; and a discharge suppressing portion movable between a first position in which said discharge suppressing portion is remote from said discharge opening and a second position in which said discharge suppressing portion is close to said discharge opening, wherein said discharge suppressing portion is in the second position at least for a predetermined period of time when said pump portion is in the minimum volume state.

According to another aspect of the present invention, there is provided an image forming system including a developer supply container and a developer supplying device to which the developer supply container is detachably mountable, said image forming system comprising said developer supplying device including, a mounting portion configured to dismountably mount said developer supply container; a developer receiving portion for receiving a developer from said developer supply container; said developer supply container including, a developer accommodating portion capable of accommodating a developer; a storage portion capable of storing the developer; said storage portion being provided with a discharge opening configured to permit discharge of the developer from said storage portion to said developer receiving portion; and a pump portion changeable between a maximum volume state and a minimum volume state and actable to said discharge opening; a discharge suppressing portion movable between a first position in which said discharge suppressing portion is remote from said discharge opening and a second position in which said discharge suppressing portion is close to said discharge opening, wherein said discharge suppressing portion is in the second position at least for a predetermined period of time when said pump portion is in the minimum volume state.

Further features of the present invention will become apparent from the following description of exemplary embodiments with reference to the attached drawings.

DESCRIPTION OF THE EMBODIMENTS

First, basic structures of an image forming apparatus will be described, and then a developer replenishing apparatus and a developer supply container used in the image forming apparatus will be described.

<Image Forming Apparatus>

Figure 1:
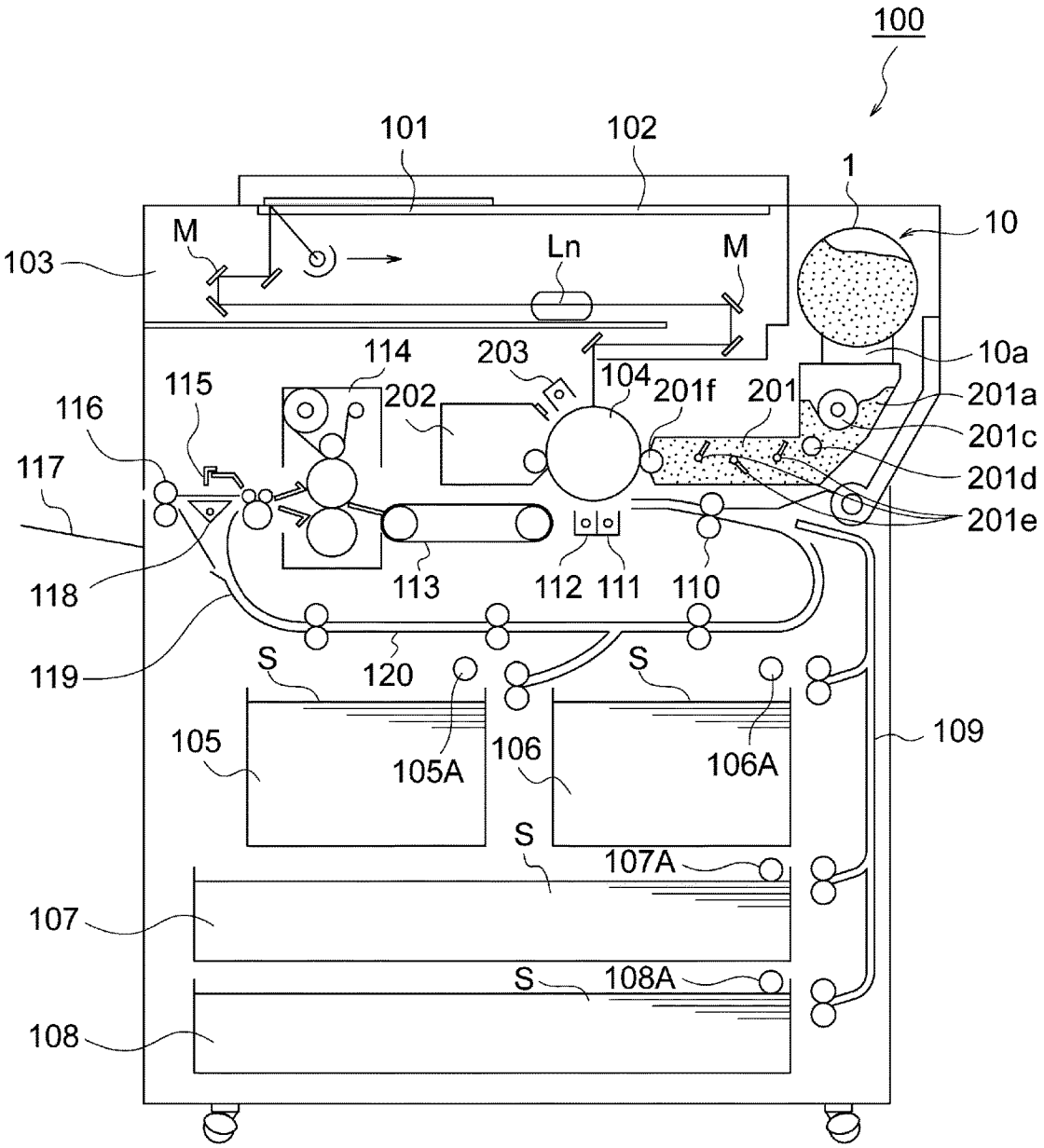
FIG. 1 illustrates an image forming apparatus usable with an embodiment of the present invention.

Referring to FIG. 1, the description will be made as to structures of a copying machine (electrophotographic image forming apparatus) employing an electrophotographic type process as an example of an image forming apparatus using a developer replenishing apparatus to which a developer supply container (so-called toner cartridge) is detachably mountable.

In FIG. 1, designated by 100 is a main assembly of the copying machine (main assembly of the image forming apparatus or main assembly of the apparatus). Designated by 101 is an original which is placed on an original supporting platen glass 102. A light image corresponding to image information of the original is imaged on an electrophotographic photosensitive member 104 (photosensitive member) by way of a plurality of mirrors M of an optical portion 103 and a lens Ln, so that an electrostatic latent image is formed. The electrostatic latent image is visualized with toner (one component magnetic toner) as a developer (dry powder) by a dry type developing device (one component developing device) 201*a*.

In this embodiment, the one component magnetic toner is used as the developer to be supplied from a developer supply container 1, but the present invention is not limited to the example and includes other examples which will be described hereinafter.

Specifically, in the case that a one component developing device using the one component non-magnetic toner is employed, the one component non-magnetic toner is supplied as the developer. In addition, in the case that a two component developing device using a two component developer containing mixed magnetic carrier and non-magnetic toner is employed, the non-magnetic toner is supplied as the developer. In such a case, both of the non-magnetic toner and the magnetic carrier may be supplied as the developer.

Designated by 105-108 are cassettes accommodating sheets S. Of the sheets S stacked in the cassettes 105-108, an optimum cassette is selected on the basis of a sheet size of the original 101 or information inputted by the operator (user) from a liquid crystal operating portion of the copying machine.

One sheet S supplied by a separation and feeding device 105A-108A is fed to registration rollers 110 along a feeding portion 109, and is fed at timing synchronized with rotation of a photosensitive member 104 and with scanning by an optical portion 103.

Designated by 111, 112 are a transfer charger and a separation charger. An image of the developer formed on the photosensitive member 104 is transferred onto the sheet S by a transfer charger 111. Then, the sheet S carrying the developed image (toner image) transferred thereonto is separated from the photosensitive member 104 by the separation charger 112.

Thereafter, the sheet S fed by the feeding portion 113 is subjected to heat and pressure in a fixing portion 114 so that the developed image on the sheet is fixed, and then passes through a discharging/reversing portion 115, in the case of one-sided copy mode, and subsequently the sheet S is discharged to a discharging tray 117 by discharging rollers 116.

In the case of a duplex copy mode, the sheet S enters the discharging/reversing portion 115 and a part thereof is ejected once to an outside of the apparatus by the discharging roller 116. The trailing end thereof passes through a flapper 118, and a flapper 118 is controlled when it is still nipped by the discharging rollers 116, and the discharging rollers 116 are rotated reversely, so that the sheet S is refed into the apparatus. Then, the sheet S is fed to the registration rollers 110 by way of re-feeding portions 119, 120, and then conveyed along the path similarly to the case of the one-sided copy mode and is discharged to the discharging tray 117.

In the main assembly of the apparatus 100, around the photosensitive member 104, there are provided image forming process equipment (process means) such as a developing device 201*a* as the developing means, a cleaner portion 202 as a cleaning means, and a primary charger 203 as charging means. The developing device 201*a* develops the electrostatic latent image formed on the photosensitive member 104 by the optical portion 103 in accordance with image information of the original 101, by depositing the developer (toner) onto the latent image. The primary charger 203 functions to uniformly charge the surface of the photosensitive member 104 so that an intended electrostatic image is formed on the photosensitive member 104. In addition, the cleanup portion 202 is to remove the developer remaining on the photosensitive member 104.

<Developer Supplying Apparatus>

Figure 2:
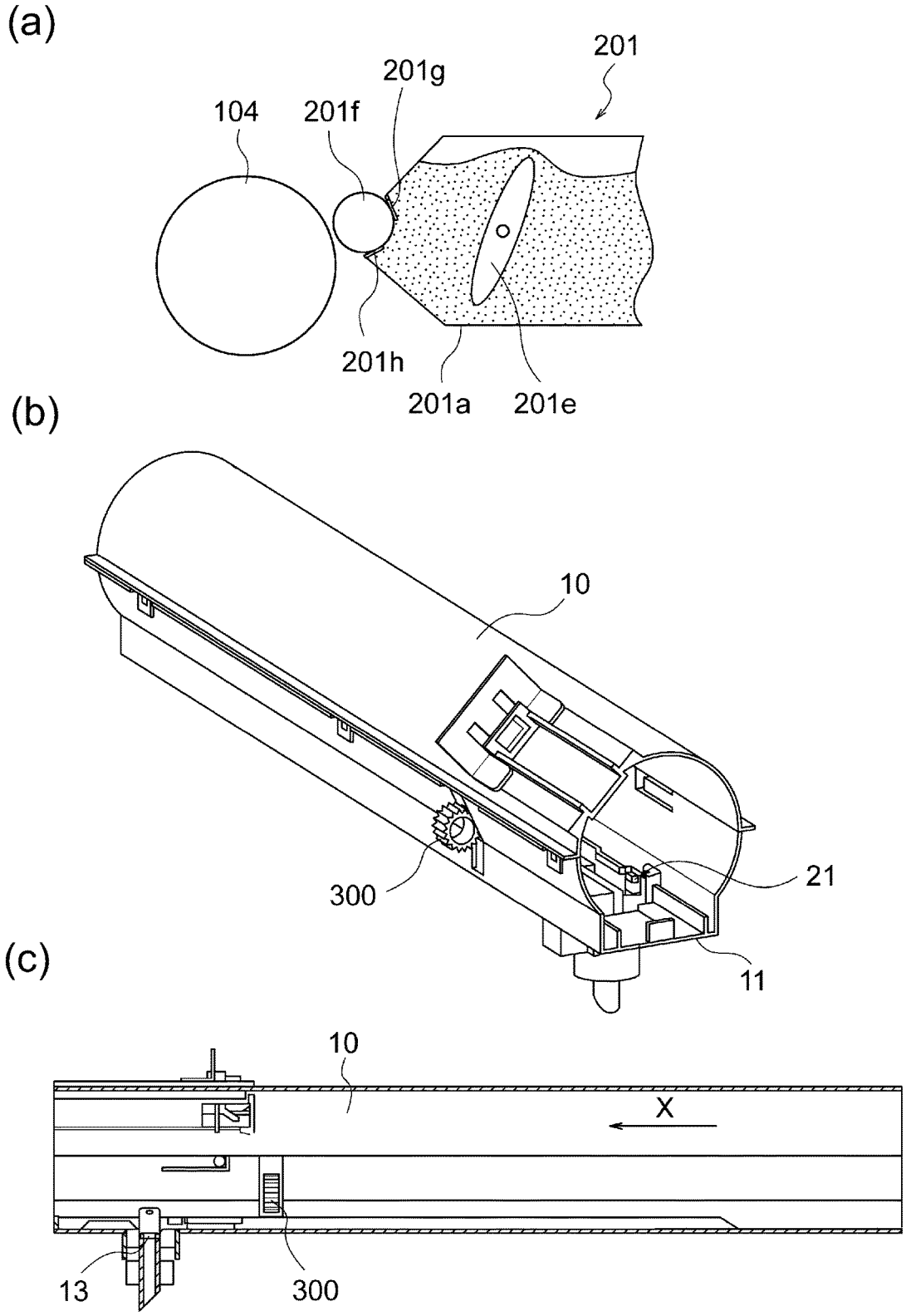
FIG. 2 illustrates a developer supplying apparatus according to an embodiment of the present invention.
Figure 3:
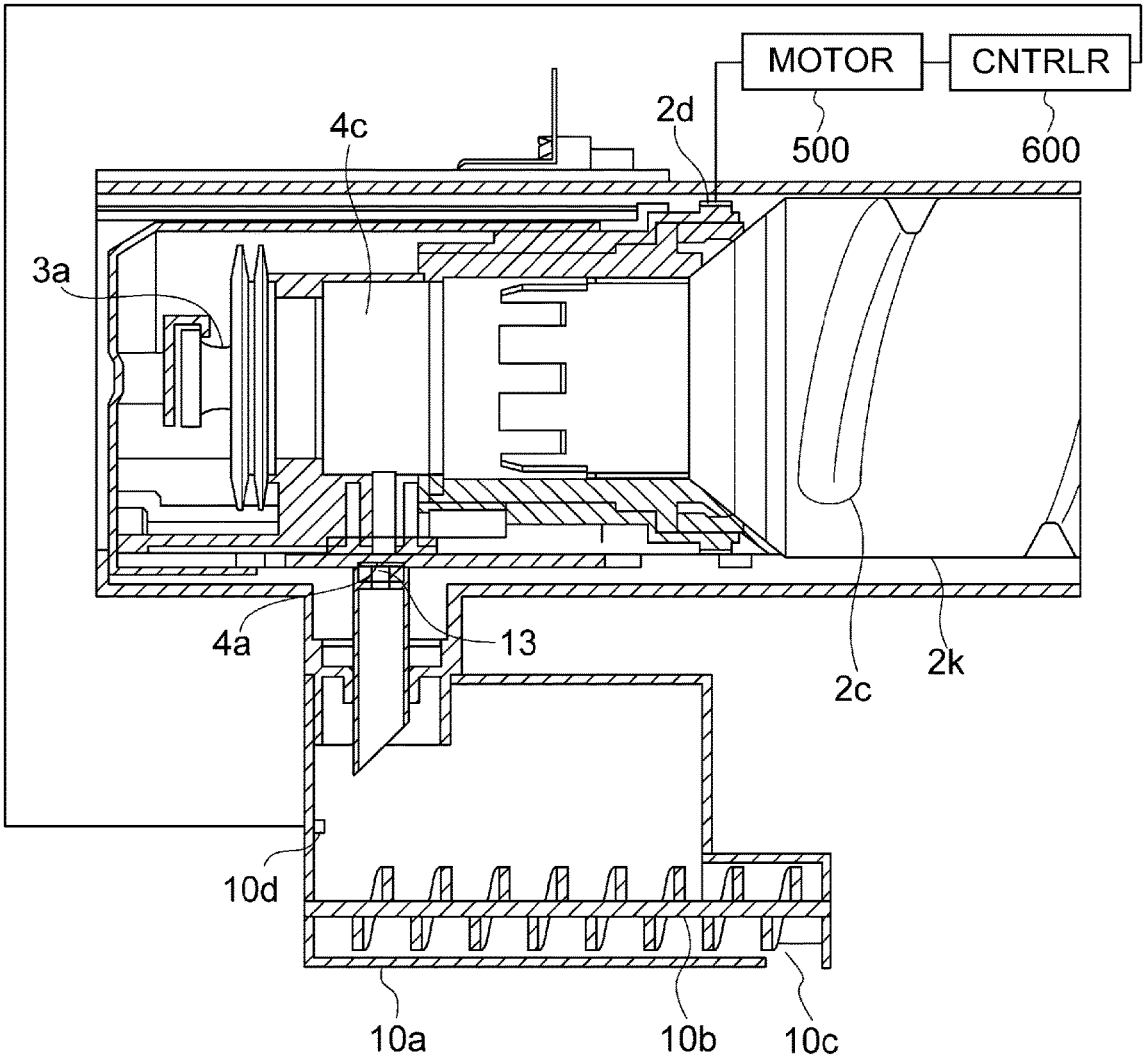
FIG. 3 is a partially sectional view of the developer supplying apparatus according to an embodiment of the present invention.
Figure 4:
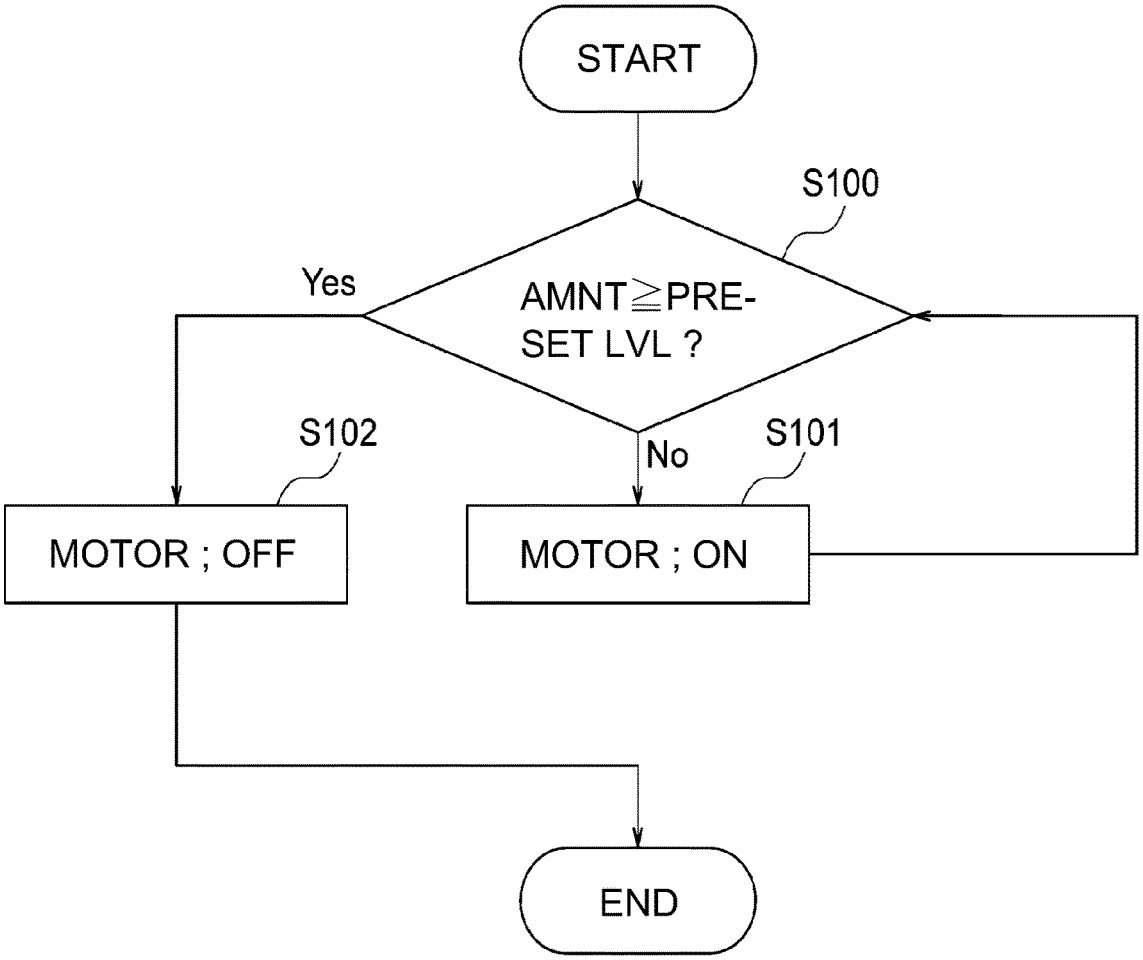
FIG. 4 is a flow chart of a developer supplying operation.

Referring to FIGS. 1-4, a developer replenishing apparatus 201 which is a constituent-element of the developer supplying system will be described. Part (a) of FIG. 2 is a partially sectional view of the developer supplying apparatus, (b) is a perspective view of a mounting portion, and (c) is a sectional view of the mounting portion. FIG. 3 is a partly enlarged sectional view of a control system, the developer supply container 1 and the developer replenishing apparatus 201. FIG. 4 is a flow chart illustrating a flow of developer supply operation by the control system.

As shown in FIG. 1, the developer replenishing apparatus 201 comprises the mounting portion (mounting space) 10, to which the developer supply container 1 is mounted dismountably, a hopper 10*a* for storing temporarily the developer discharged from the developer supply container 1, and the developing device 201*a*. As shown in part (c) of FIG. 2, the developer supply container 1 is mountable in a direction indicated by an arrow X to the mounting portion 10. Thus, a longitudinal direction (rotational axis direction) of the developer supply container 1 is substantially the same as the direction of arrow M. The direction of arrow X is substantially parallel with a direction indicated by X of part (b) of FIG. 7 which will be described hereinafter. In addition, a dismounting direction of the developer supply container 1 from the mounting portion 10 is opposite the direction (inserting direction) of the arrow X.

As shown in parts (a) of FIGS. 1 and 2, the developing device 201*a* comprises a developing roller 201*f*, a stirring member 201*c*, and feeding members 201*d* and 201*e*. The developer supplied from the developer supply container 1 is stirred by the stirring member 201*c*, is fed to the developing roller 201*f* by the magnet roller 201*d* and the feeding member 201*e*, and is supplied to the photosensitive member 104 by the developing roller 201*f*.

A developing blade 201*g* for regulating an amount of developer coating on the roller is provided relative to the developing roller 201*f*, and a leakage preventing sheet 201*h* is provided contacted to the developing roller 201*f* to prevent leakage of the developer between the developing device 201*a* and the developing roller 201*f*.

As shown in part (b) of FIG. 2, the mounting portion 10 is provided with a rotation regulating portion 11 for limiting movement of the flange portion 4 in the rotational moving direction by abutting to a flange portion 4 (FIG. 6) of the developer supply container 1 when the developer supply container 1 is mounted.

Furthermore, the mounting portion 10 is provided with a developer receiving port (developer reception hole) 13 for receiving the developer discharged from the developer supply container 1, and the developer receiving port is brought into fluid communication with a discharge opening (discharging port) 4*a* (FIG. 6) of the developer supply container 1 which will be described hereinafter, when the developer supply container 1 is mounted thereto. The developer is supplied from the second discharge opening 4*a* of the developer supply container 1 to the developing device 201*a* through the developer receiving port 13. In this embodiment, a diameter φ of the developer receiving port 13 is approx. 2.5 mm (pin hole), for the purpose of preventing as much as possible the contamination by the developer in the mounting portion 10. The diameter of the developer receiving port may be any if the developer can be discharged through the second discharge opening 4*a*.

As shown in FIG. 3, the hopper 10*a* comprises a feeding screw 10*b* for feeding the developer to the developing device 201*a*, an opening 10*c* in fluid communication with the developing device 201*a*, and a developer sensor 10*d* for detecting an amount of the developer accommodated in the hopper 10*a*.

As shown in parts (b) and (c) of FIG. 2, the mounting portion 10 is provided with a driving gear 300 functioning as a driving mechanism (driver). The driving gear 300 receives a rotational force from a driving motor 500 (unshown) through a driving gear train, and functions to apply a rotational force to the developer supply container 1 which is set in the mounting portion 10.

As shown in FIG. 3, the driving motor 500 is controlled by a control device (CPU) 600. As shown in FIG. 3, the control device 600 controls the operation of the driving motor 500 on the basis of information indicative of a developer remainder inputted from the remaining developer sensor 10*d*.

In this example, the driving gear 300 is rotatable unidirectionally to simplify the control for the driving motor 500. The control device 600 controls only ON (operation) and OFF (non-operation) of the driving motor 500. This simplifies the driving mechanism for the developer replenishing apparatus 201 as compared with a structure in which forward and backward driving forces are provided by periodically rotating the driving motor 500 (driving gear 300) in the forward direction and backward direction.

<Mounting/Dismounting Method of Developer Supply Container>

The description will be made as to a mounting/dismounting method of the developer supply container 1.

First, the operator opens an exchange cover and inserts and mounts the developer supply container 1 to a mounting portion 10 of the developer replenishing apparatus 201. By the mounting operation, the flange portion 4 of the developer supply container 1 is held and fixed in the developer replenishing apparatus 201.

Thereafter, the operator closes the exchange cover to complete the mounting step. Thereafter, the control device 600 controls the driving motor 500, by which the driving gear 300 rotates at proper timing.

On the other hand, when the developer supply container 1 becomes empty, the operator opens the exchange cover and takes the developer supply container 1 out of the mounting portion 10. The operator inserts and mounts a new developer supply container 1 prepared beforehand and closes the exchange cover, by which the exchanging operation from the removal to the remounting of the developer supply container 1 is completed.

<Developer Supply Control by Developer Replenishing Apparatus>

Referring to a flow chart of FIG. 4, a developer supply control by the developer replenishing apparatus 201 will be described. The developer supply control is executed by controlling various devices by the control device (CPU) 600.

In this embodiment, the control device 600 controls the operation/non-operation of the driving motor 500 in accordance with an output of the developer sensor 10*d* by which the developer is not accommodated in the hopper 10*a* beyond a predetermined amount.

More particularly, first, the developer sensor 10*d* checks the accommodated developer amount in the hopper 10*a*. When the accommodated developer amount detected by the developer sensor 10*d* is discriminated as being less than a predetermined amount, that is, when no developer is detected by the developer sensor 10*d*, the driving motor 500 is actuated to execute a developer supplying operation for a predetermined time period (S101).

The accommodated developer amount detected with developer sensor 10*d* is discriminated as having reached the predetermined amount, that is, when the developer is detected by the developer sensor 10*d*, as a result of the developer supplying operation, the driving motor 500 is deactuated to stop the developer supplying operation (S102). By the stop of the supplying operation, a series of developer supplying steps is completed.

Such developer supplying steps are carried out repeatedly whenever the accommodated developer amount in the hopper 10*a* becomes less than a predetermined amount as a result of consumption of the developer by the image forming operations.

The structure may be such that the developer discharged from the developer supply container 1 is stored temporarily in the hopper 10*a*, and then is supplied into the developing device 201*a*.

Figure 5:
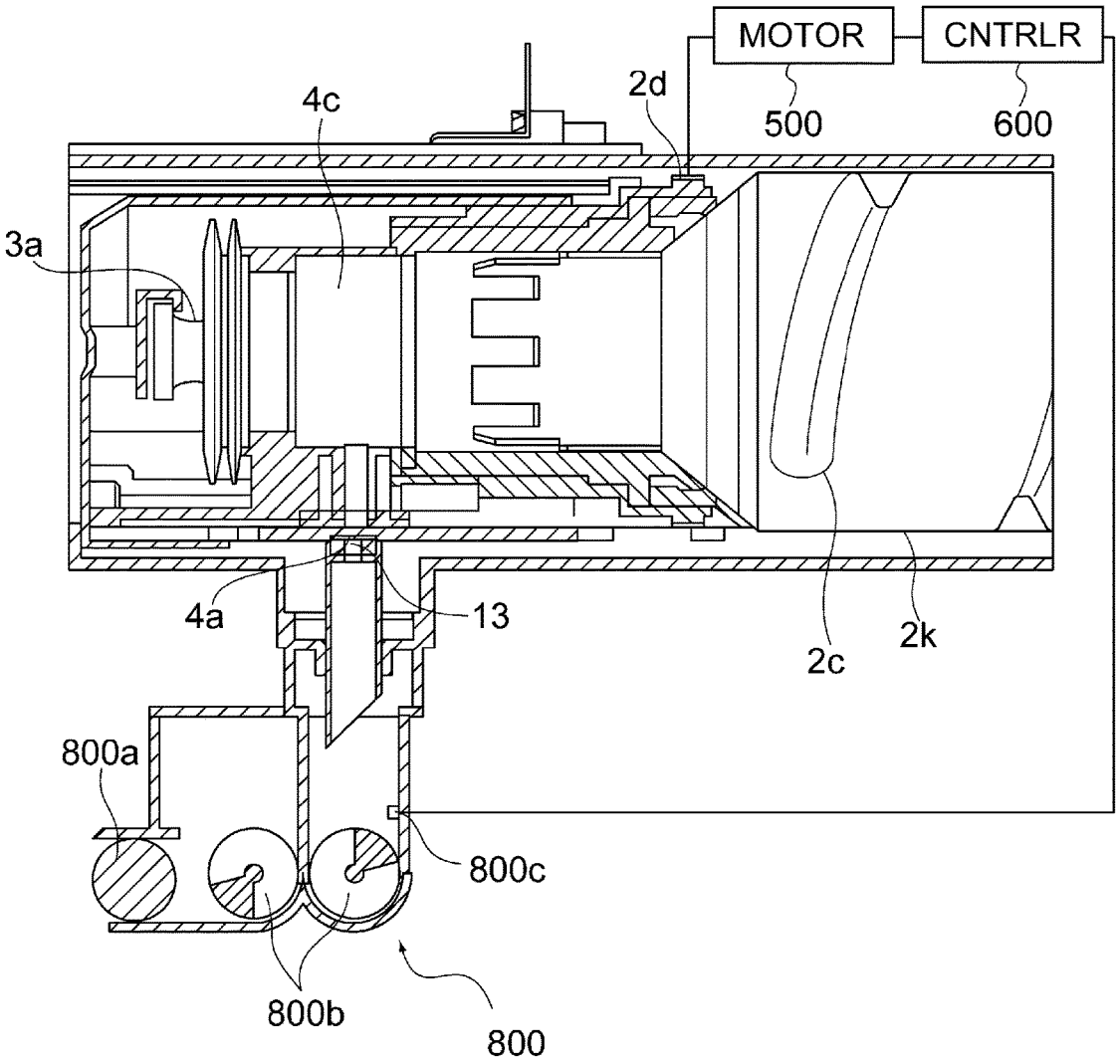
FIG. 5 is a partially sectional view of the developer supplying apparatus according to an embodiment of the present invention.

More specifically, the following structure of the developer replenishing apparatus 201 can be employed; as shown in FIG. 5, the above-described hopper 10*a* is omitted, and the developer is supplied directly into the developing device 201*a* from the developer supply container 1. FIG. 5 shows an example using a two component developing device 800 as a developer replenishing apparatus 201. The developing device 800 comprises a stirring chamber into which the developer is supplied, and a developer chamber for supplying the developer to the developing sleeve 800*a*, wherein the stirring chamber and the developer chamber are provided with stirring screws 800*b* rotatable in such directions that the developer is fed in the opposite directions from each other. The stirring chamber and the developer chamber are communicated with each other in the opposite longitudinal end portions, and the two component developer are circulated in the two chambers. The stirring chamber is provided with a magnetometric sensor 800*c* for detecting a toner content of the developer, and on the basis of the detection result of the magnetometric sensor 800*c*, the control device 600 controls the operation of the driving motor 500. In such a case, the developer supplied from the developer supply container is non-magnetic toner or non-magnetic toner plus magnetic carrier.

In this example, as will be described hereinafter, the developer in the developer supply container 1 is hardly discharged through the discharge opening 4*a* only by the gravitation, but the developer is discharged by a volume changing operation of a pump portion 3*b*, and therefore, variation in the discharge amount can be suppressed. Therefore, the developer supply container 1 which will be described hereinafter is usable for the example of FIG. 5 lacking the hopper 10*a*, and the supply of the developer into the developing chamber is stable with such a structure.

<Developer Supply Container>

Figure 6:
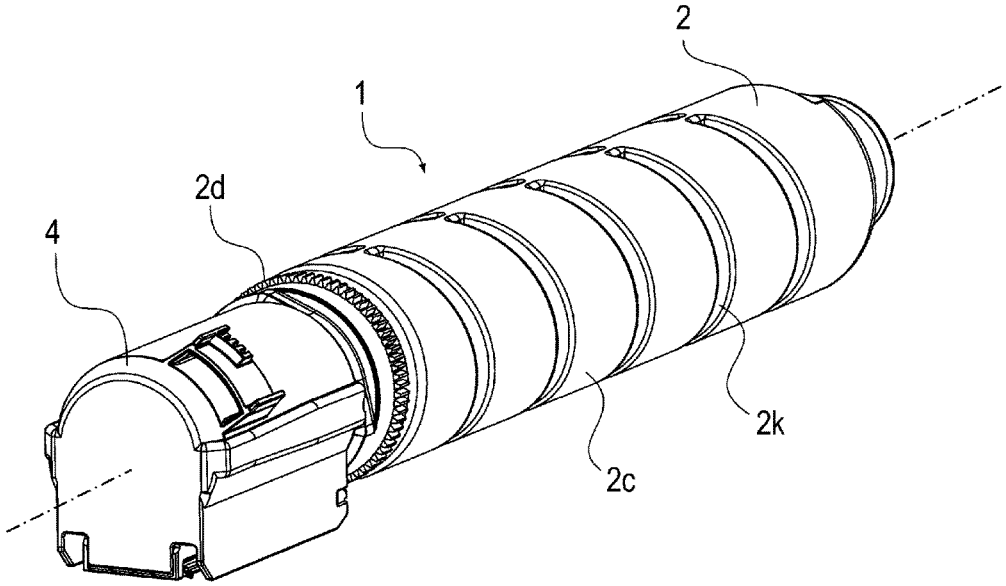
FIG. 6 illustrates a developer supply container according to an embodiment of the present invention.
Figure 6:
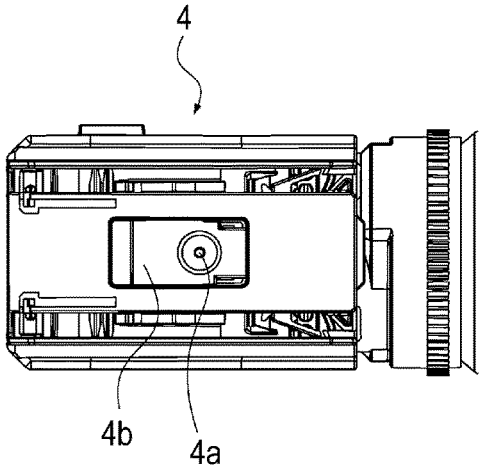
Figure 6:
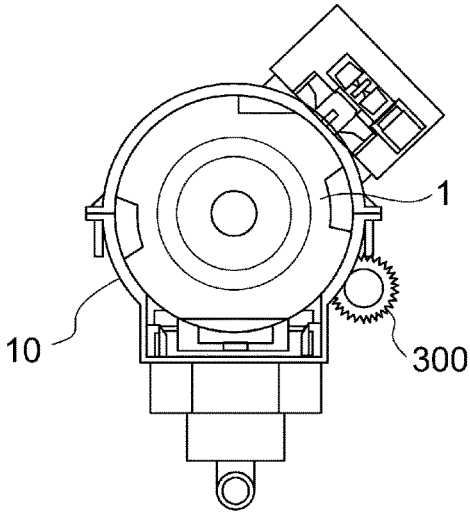
Figure 7:
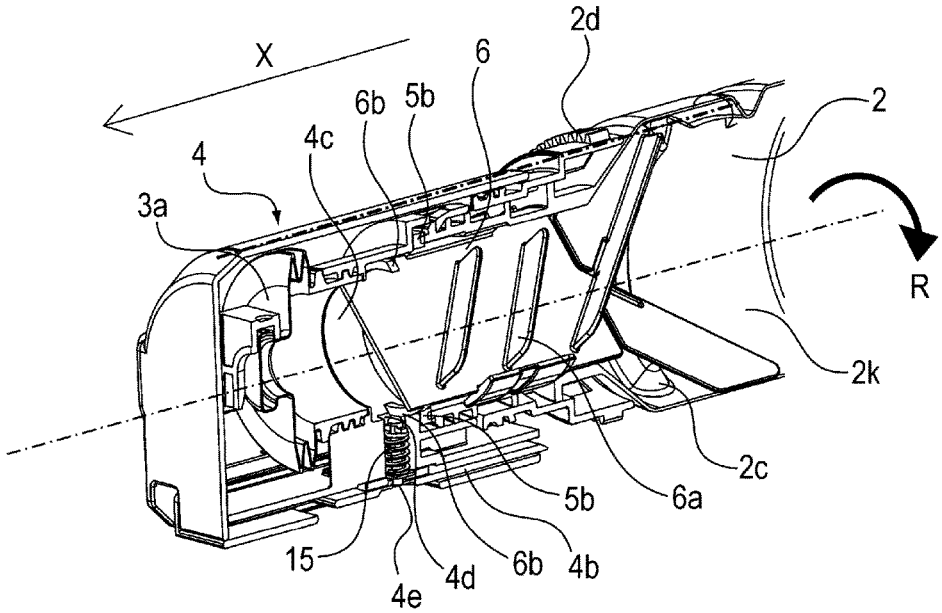
FIG. 7 illustrates a developer supply container according to an embodiment of the present invention.
Figure 7:
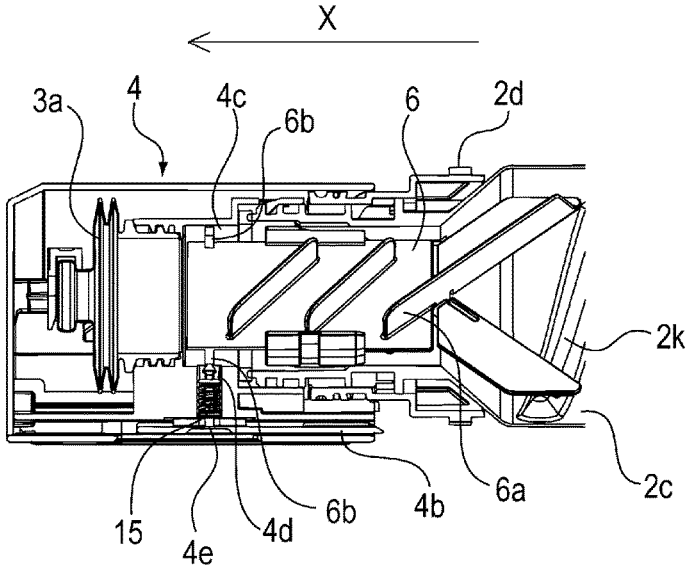
Figure 7:
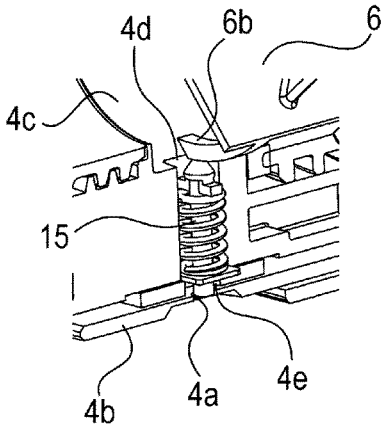

Referring to FIGS. 6 and 7, the structure of the developer supply container 1 which is a constituent-element of the developer supplying system will be described. Part (a) of FIG. 6 is a perspective view illustrating the developer supply container according to Embodiment 1 of the present invention, (b) is a partial enlarged view illustrating a state around a discharge opening, and (c) is a front view illustrating a state in which the developer supply container is mounted to the mounting portion of the developer supplying apparatus.

As shown in part (a) of FIG. 6, the developer supply container 1 includes a developer accommodating portion 2 having a hollow cylindrical inside space for accommodating the developer. In this embodiment, a cylindrical portion 2*k* and the discharging portion 4*c* (FIG. 5) function as the developer accommodating portion 2. Furthermore, the developer supply container 1 is provided with a flange portion 4 at one end of the developer accommodating portion 2 with respect to the longitudinal direction (developer feeding direction). The cylindrical portion 2 is rotatable relative to the flange portion 4. A cross-sectional configuration of the cylindrical portion 2*k* may be non-circular as long as the non-circular shape does not adversely affect the rotating operation in the developer supplying step. For example, it may be an oval configuration, polygonal configuration or the like.

In the following, the description will be made as to the structures of the flange portion 4, the cylindrical portion 2*k*, the pump portion 3*a*, the drive inputting portion and the drive converting mechanism of the developer supply container 1.

<Cylindrical Portion>

Part (a) of FIG. 7 is a partial sectional perspective view of the developer supply container, part (b) of FIG. 7 is a partially sectional view thereof in the state that the pump portion 3*a* is expanded to the maximum usable limit, and part (c) of FIG. 7 is an expanded partial sectional perspective view of a neighborhood of a developer storage portion 4*d* and the discharging controlling mechanism 15 of the developer supply container 1.

As shown in part (a) of FIG. 7, the cylindrical portion 2*k* is provided with a helical feeding projection 2*c* functioning as a means for feeding the developer by the rotation in the direction indicated by a arrow R toward the discharging portion 4*c* functioning as a developer discharging chamber. The cylindrical portion 2*k* is produced from polyethylene terephthalate resin material by a two axis-expansion blow molding method.

As shown in part (a) of FIG. 7, the cylindrical portion 2*k* is provided rotatably relative to the flange portion 4, while compressing the flange seal 5*b* of a ring-like sealing member provided on the inside surface of the flange portion 4.

By this, the cylindrical portion 2*k* rotates while sliding on the flange seal 5*b* without leakage of the developer during the rotation, thus assuring the hermetical property. That is, the flow of the air through the second discharge opening 4*a* in both directions, shown in part (c) of FIG. 7 is proper, and therefore, the volume change of the developer supply container 1 during the supplying operation is as desired.

<Flange Portion>

The flange portion 4 will be described. As shown in parts (a) and (b) of FIG. 7, there is provided a hollow discharging portion 4*c* for temporarily storing the developer fed from the cylindrical portion 2*k*. As shown in part (c) of FIG. 7, a bottom of the discharging portion 4*c* is provided with a first discharge opening 4*e* for permitting discharge of the developer from the discharging portion 4*c*. Above the first discharge opening 4*e*, the developer storage portion 4*d* capable of storing a predetermined amount of the developer which is going to discharge is provided. The developer storage portion 4*d* is provided with a discharging controlling mechanism (discharging suppressing means) 15 for controlling an amount of the developer discharged through the first discharge opening 4*e*. The discharging controlling mechanism 15 will be described hereinafter.

The flange portion 4 is provided with a shutter 4*b* for opening and closing first discharge opening 4*e*. The shutter 4*b* is provided with a small discharge opening 4*a* (second discharge opening 4*a*) which is to be brought into fluid communication with the first discharge opening 4*e* by the mounting operation of the developer supply container 1 and which is effective to supply the developer into the developer supplying apparatus 201. The shutter 4*b* is brought into abutment with the abutting portion 21 (part (b) of FIG. 2) provided on the mounting portion 10 (part (b) of FIG. 2), with the mounting operation of the developer supply container 1 to the mounting portion 10. Therefore, with the mounting operation of the developer supply container 1 to the mounting portion 10 in the direction X, the shutter 4*b* slides in the direction opposite to the X direction relative to the developer supply container 1. As a result, as shown in part (c) of FIG. 7, second discharge opening 4*a* of the shutter 4*b* is brought into fluid communication with the first discharge opening 4*e*, thus completing the unsealing operation. At this time, the second discharge opening 4*a* is aligned with the developer receiving port 13 (FIG. 5) of the mounting portion 10, thus enabling the developer supply from the developer supply container 1.

When the developer supply container 1 is mounted to the mounting portion 10 of the developer supplying apparatus 201, the flange portion 4 becomes substantially stationary. More particularly, the rotational moving direction regulating portion 11 shown in part (b) of FIG. 2 is provided to prevent the rotation of the flange portion 4 in the rotating direction of the cylindrical portion 2*k*. Therefore, in the state in which the developer supply container 1 is mounted in the developer supplying apparatus 201, the discharging portion 4*c* of the flange portion 4 is also prevented substantially from rotating in the rotating direction of the cylindrical portion 2*k*, although the movement within the play is permitted.

On the other hand, the cylindrical portion 2*k* is not limited in the rotational direction by the developer supplying apparatus 201, so that it is rotated for the developer supply. As shown in part (a) of FIG. 7, there is provided a plate-like feeding member 6 for feeding the developer fed from the cylindrical portion 2*k* by the helical feeding projection (inward projection) 2*c*, into the discharging portion 4*c*.

<Feeding Member>

Figure 8:
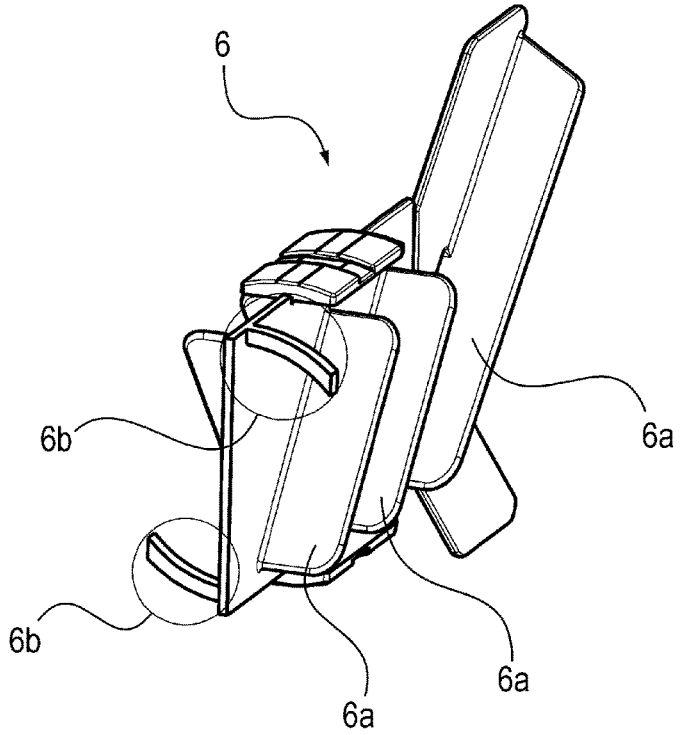
FIG. 8 illustrates a feeding member for the developer supply container according to an embodiment of the present invention.
Figure 8:
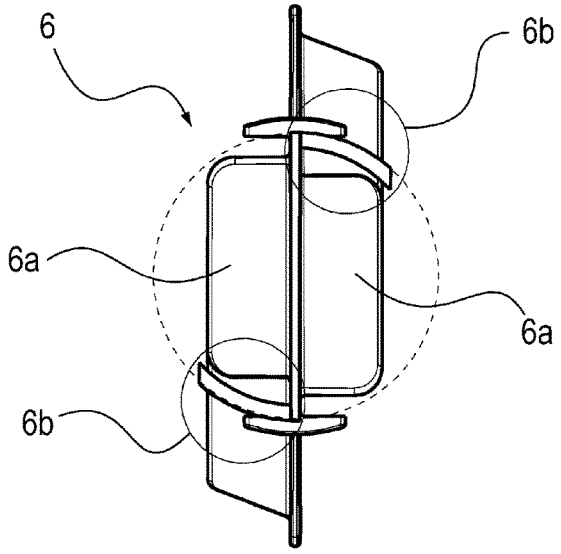

Referring to FIG. 8, the feeding member 6 for feeding the developer from the developer accommodating portion to the discharge opening will be described. The feeding member 6 is rotatable integrally with the cylindrical portion 2*k* (part (a) of FIG. 6), and is provided with a plurality of inclination ribs 6*a* inclined toward the discharging portion 4*c* relative to the rotational axis direction of the cylindrical portion 2*k* (part (a) of FIG. 7), on each side thereof.

With the above-described structure, the developer fed by the feeding projection 2*c* (part (a) of FIG. 6) is scooped up by the plate-like feeding member 6 in interrelation with the rotation of the cylindrical portion 2*k*. Thereafter, with the further rotation of the cylindrical portion 2*k*, the developer slides down on the surface of the feeding member 6 by the gravity, and sooner or later, the developer is transferred to the discharging portion 4*c* by the inclination ribs 6*a*. With this structure of this embodiment, the inclination ribs 6*a* are provided on each of the sides of the feeding member 6 so that the developer is fed into the discharging portion 4*c* and the discharging portion 4*c* for each half of the full-turn of the cylindrical portion 2*k*.

At a discharging portion 4*c* side free end portion of the feeding member 6 is provided with a pushing portion 6*b* as a regulating portion contacting an engaging portion 15*a*1 (part (a) of FIG. 9) provided on the control rod 15*a* which is a movable member provided in the discharging controlling mechanism 15 which will be described hereinafter. The pushing portion 6*b* is arcuate about the rotation axis of the feeding member 6 and is provided at each of two positions circumferentially 180° away from each other, so that by one full rotation of the feeding member 6, two contacts (part (b) of FIG. 17) and spacings (part (b) of FIG. 14) relative to the engaging portion 15*a*1 are carried out. In this embodiment, the pushing portion 6*b* is provided at each of the two positions, but the number is not limited to two. The number may be properly selected by one skilled in the art depending on the specifications of the developer supply container 1 and on the usage thereof in the main assembly.

<Discharging Controlling Mechanism>

Figure 9:
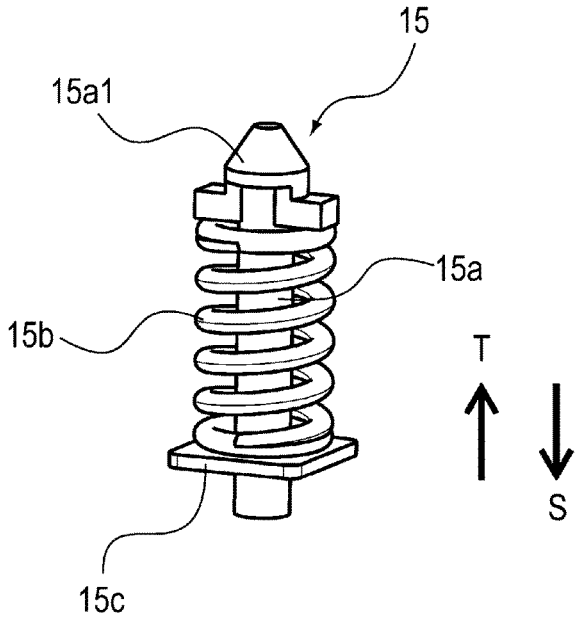
FIG. 9 illustrates a discharging controlling mechanism for a developer supply container according to an embodiment of the present invention.
Figure 9:
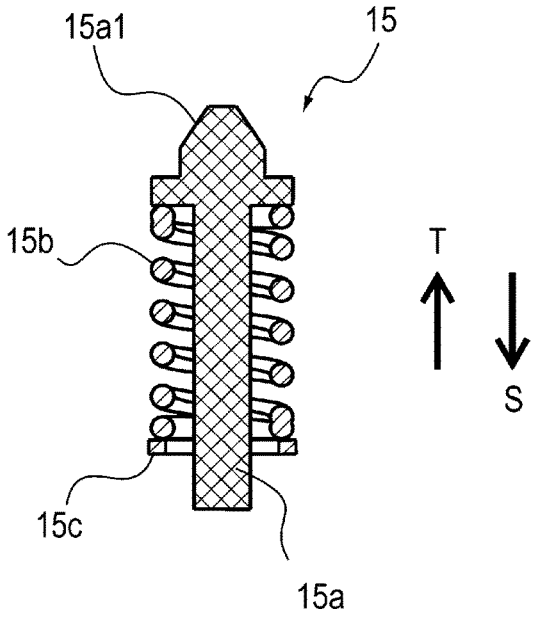

Referring to FIG. 9, the discharging controlling mechanism will be described. Part (a) of FIG. 9 is a perspective view of the discharging controlling mechanism, and part (b) of FIG. 9 is a sectional view of the discharging controlling mechanism.

As shown in FIG. 9, the discharging controlling mechanism 15 as the above-described discharging suppressing means comprises at least the control rod 15*a* extending in the developer storage portion 4*d*, an urging member 15*b* for urging the control rod 15*a* in the direction away from the second discharge opening 4*a*, and a pedestal 15*c* for holding the urging member 15*b*. The pedestal 15*c* is fixed on the lower end side of the developer storage portion 4*d* by bonding, welding or the like. As shown in part (b) of FIG. 9, the pedestal 15*c* is provided at the center with a through-hole through which the control rod 15*a* is penetrated. The size of the through-hole is larger than an outer diameter of the control rod 15*a*, and the gap between the inner surface of the through-hole and the outer peripheral surface of the control rod 15*a* is enough to permit flow of the developer therethrough without the stagnation.

The control rod 15*a* is provided at a free end portion facing the second discharge opening 4*a* with an engaging portion 15*a*1 having a substantially trigonal pyramid shape. The control rod 15*a* is urged upwardly by the urging member 15*b* and is movable in the up and down direction. When the engaging portion 15*a*1 is not pushed in, a bottom end portion of the control rod 15*a* is a first position spaced from the second discharge opening 4*a*.

By the engaging portion 15*a*1 being contacted by the pushing portion 6*b* formed on the feeding member 6, the control rod 15*a* is pushed down against the urging force of the urging member 15*b* through the through-hole of the pedestal 15*c* in the direction indicated by an arrow S in the Figure, so that the bottom end portion thereof is moved in the developer storage portion to a second position close to the second discharge opening 4*a*. When the contact state with the pushing portion 6*b* is released (the engaging portion 15*a*1 is spaced from the pushing portion 6*b*), the control rod 15*a* is moved by the urging force of the urging member 15*b* in the direction away from the second discharge opening 4*a*

(arrow T direction in the Figure) to the first position. As described hereinbefore, the feeding member 6 rotates integrally with the cylindrical portion 2*k*, and with the rotation of the feeding member 6, the pushing portion 6*b* of the feeding member 6 and the engaging portion 15*a*1 of the control rod 15*a* repeats the contacting and spacing.

Figure 10:
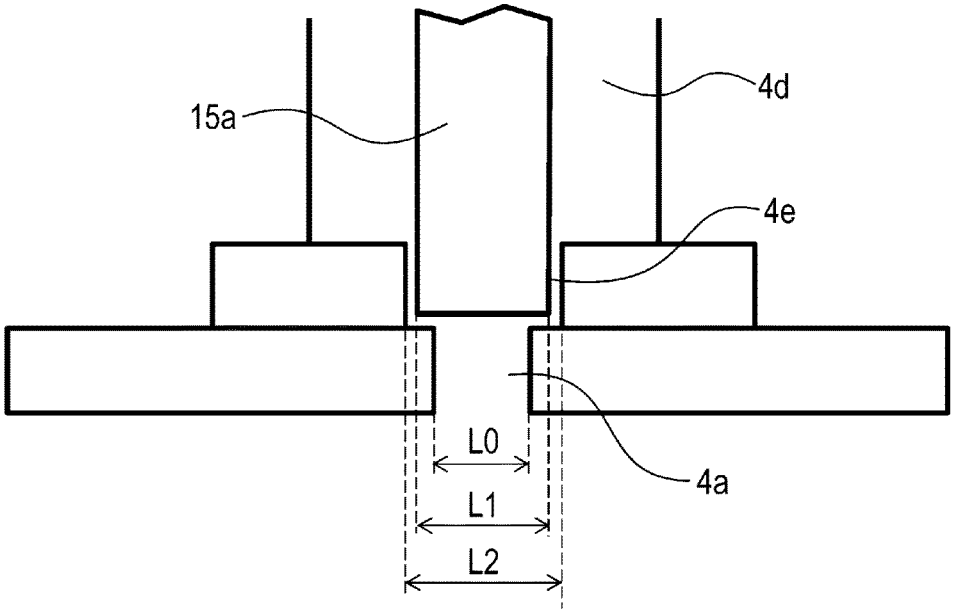
FIG. 10 is a schematic enlarged view of a neighborhood of a developer storage portion of a developer supply container according to an embodiment of the present invention.
Figure 10:
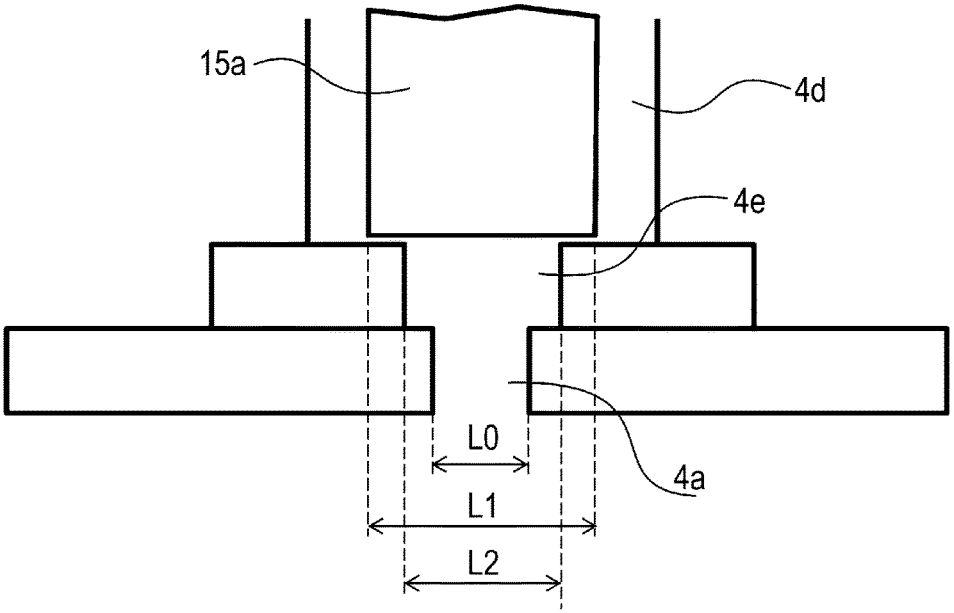

As shown in part (a) of FIG. 10, in this embodiment, when the control rod 15*a* is in the position closest to the second discharge opening 4*a* (second position), the lower end of the control rod 15*a* enters the first discharge opening 4*e*. In this embodiment, the diameter L0 of the second discharge opening 4*a*, the diameter L1 of the control rod 15, and diameter L2 of the first discharge opening 4*e* satisfy L0<L1<L2. The control of the discharging amount of the developer which will be described hereinafter is effected by preventing the discharge of the developer through the second discharge opening 4*a* by the control rod 15*a*. When the diameter L1 of the control rod 15*a* is larger than the diameter L2 of the first discharge opening 4*e* as shown in part (b) of FIG. 10 (L0<L2<L1), as is different from this embodiment, it is preferable that the second position of the lower end of the control rod 15*a* pushed by the pushing portion 6*b* feeding member 6 is adjacent to the first discharge opening 4*e* (not entering the first discharge opening 4*e*). In such a case, the control of the discharge amount which will be described hereinafter it is effected by preventing the discharge of the developer through the first discharge opening 4*e* by the control rod 15*a*. That is, depending on the sizes of and/or the relationship between the diameter L0 of the second discharge opening 4*a*, the diameter L1 of the control rod 15*a* and/or the diameter L2 of the first discharge opening 4*e*, the displacement amount of the control rod 15*a* by the pushing portion 6*b* of the control rod 15*a* is properly selected.

<Pump Portion>

Referring to FIG. 7, the description will be made as to the pump portion (reciprocable pump) 3*a* in which the volume thereof changes with reciprocation.

The pump portion 3*a* of this embodiment functions as a suction and discharging mechanism for repeating the sucking operation and the discharging operation alternately through the second discharge opening 4*a*. In other words, the pump portion 3*a* functions as an air flow generating mechanism for generating repeatedly and alternately air flow into the developer supply container and air flow out of the developer supply container through the second discharge opening 4*a*.

As shown in part (b) of FIG. 7, the pump portion 3*a* is secured with the discharging portion 4*c* by screwing. Thus, the pump portion 3*a* does not rotate in the rotational direction of the cylindrical portion 2*k* together with the discharging portion 4*c*.

In this embodiment, the pump portion 3*a* is a displacement type pump (bellow-like pump) of resin material in which the volume thereof changes with the reciprocation. More particularly, as shown in part (b) of FIG. 7, the bellow-like pump includes crests and bottoms periodically and alternately. The pump portion 2*b* repeats the compression and the expansion alternately by the driving force received from the developer replenishing apparatus 201.

Using the pump portion 3*a* of such a structure, the volume of the developer supply container 1 can be alternately changed between the maximum state and minimum state repeatedly at predetermined intervals. As a result, the developer in the discharging portion 4*c* can be discharged efficiently through the small diameter discharge opening 4*a* (diameter of approx. 2.5 mm) by the application of the pressure to the second discharge opening 4*a*.

<Drive Inputting Portion>

The description will be made as to a drive receiving mechanism (drive receiving portion, driving force receiving portion) of the developer supply container 1 for receiving the rotational force for rotating the cylindrical portion 2*k* provided with feeding projection 2*c* from the developer replenishing apparatus 201.

As shown in part (a) of FIG. 6, the developer supply container 1 is provided with a gear portion 2*a* which functions as a drive receiving mechanism (drive receiving portion, driving force receiving portion) engageable (driving connection) with a driving gear 300 (functioning as driving mechanism) of the developer replenishing apparatus 201. The gear portion 2*d* and the cylindrical portion 2*k* are integrally rotatable.

Therefore, the rotational force inputted to the gear portion 2*d* from the driving gear 300 is transmitted to the pump portion 3*a* through a reciprocation member 3*b* shown in part (a) and (b) of FIG. 11, as will be described in detail hereinafter. The bellow-like pump portion 3*a* of this example is made of a resin material having a high property against torsion or twisting about the axis within a range of not adversely affecting the expanding-and-contracting operation.

In this embodiment, the gear portion 2*d* is provided at one longitudinal end (developer feeding direction) of the cylindrical portion 2*k*, but this is not inevitable, and the gear portion 2*a* may be provided at the other longitudinal end side of the developer accommodating portion 2, that is, the trailing end portion. In such a case, the driving gear 300 is provided at a corresponding position.

In this embodiment, a gear mechanism is employed as the driving connection mechanism between the drive receiving portion of the developer supply container 1 and the driver of the developer replenishing apparatus 201, but this is not inevitable, and a known coupling mechanism, for example is usable. More particularly, in such a case, the structure may be such that a non-circular recess is provided as a drive receiving portion, and correspondingly, a projection having a configuration corresponding to the recess as a driver for the developer replenishing apparatus 201, so that they are in driving connection with each other.

<Drive Converting Mechanism>

Figure 11:
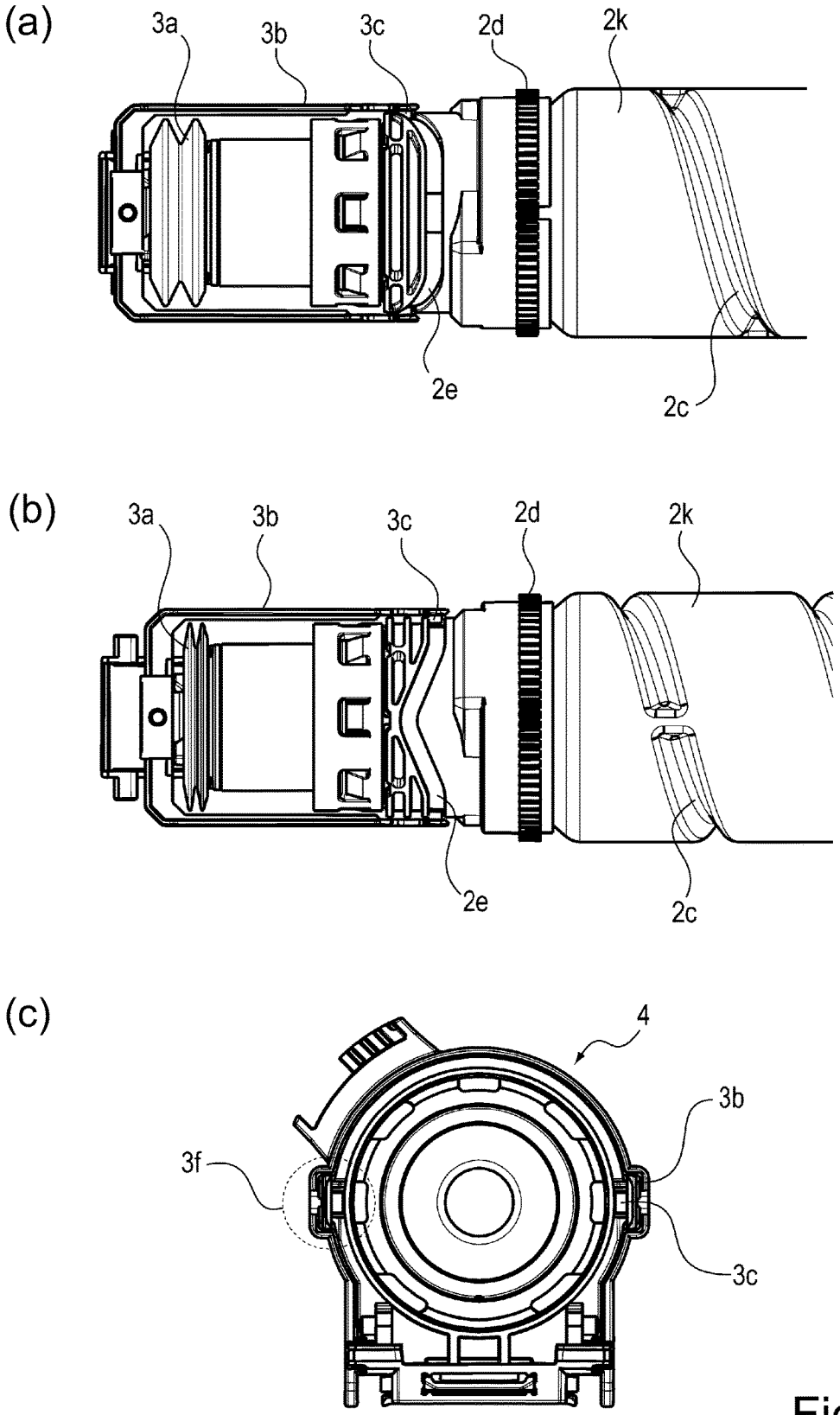
FIG. 11 illustrates a drive converting mechanism usable in an embodiment of the present invention.

Referring to FIG. 11, a drive converting mechanism (drive converting portion) for the developer supply container 1 will be described. In this embodiment, a cam mechanism is taken as an example of the drive converting mechanism. Part (a) of FIG. 11 shows the state in which the pump portion 3*a* is expanded to the maximum usable limit, part (b) of FIG. 11 shows the state in which the pump portion 3*a* is contracted to the maximum usable limit, and part (c) of FIG. 11 shows a part of the pump portion.

As shown in part (a) of FIG. 11, the developer supply container 1 is provided with the cam mechanism which functions as the drive converting mechanism for converting the rotational force for rotating the cylindrical portion 2*k* received by the gear portion 2*d* to a force in the reciprocating directions of the pump portion 3*a*.

In this example, one drive receiving portion (gear portion 2*d*) receives the driving force for rotating the cylindrical portion 2*k* and for reciprocating the pump portion 3*a*, and the rotational force received by converting the rotational driving force received by the gear portion 2*d* to a reciprocation force in the developer supply container 1 side.

Because of this structure, the structure of the drive receiving mechanism for the developer supply container 1 is simplified as compared with the case of providing the developer supply container 1 with two separate drive receiving portions. In addition, the drive is received by a single driving gear of developer replenishing apparatus 201, and therefore, the driving mechanism of the developer replenishing apparatus 201 is also simplified.

As shown in part (a) of FIG. 11 and part (b) of FIG. 11, the used member for converting the rotational force to the reciprocation force for the pump portion 3*a* is the reciprocation member 3*b*. More specifically, it includes a rotatable cam groove 2*e* extended on the entire circumference of the portion integral with the driven receiving portion (gear portion 2*d*) for receiving the rotation from the driving gear 300. The cam groove 2*e* will be described hereinafter. The cam groove 2*e* is engaged with a reciprocation member engaging projection projected from the reciprocation member 3*b*. In this embodiment, as shown in part (c) of FIG. 11, the reciprocation member 3*b* is limited in the movement in the rotational moving direction of the cylindrical portion 2*k* by a protecting member rotation regulating portion 3*f* (play will be permitted) so that the reciprocation member 3*b* does not rotate in the rotational direction of the cylindrical portion 2*k*. By the movement in the rotational moving direction limited in this manner, it reciprocates along the groove of the cam groove 2*e* (in the direction of the arrow X shown in FIG. 7 or the opposite direction). A plurality of such reciprocation member engaging projections 3*c* are provided and are engaged with the cam groove 2*e*. More particularly, two reciprocation member engaging projections 3*c* are provided opposed to each other in the diametrical direction of the cylindrical portion 2*k* (approx. 180° opposing).

The number of the reciprocation member engaging projections 3*c* is satisfactory if it is not less than one. However, in consideration of the liability that a moment is produced by the drag force during the expansion and contraction of the pump portion 3*a* with the result of unsmooth reciprocation, the number is preferably plural as long as the proper relation is assured in relation to the configuration of the cam groove 2*e* which will be described hereinafter.

In this manner, by the rotation of the cam groove 2*e* by the rotational force received from the driving gear 300, the reciprocation member engaging projection 3*c* reciprocates in the arrow X direction and the opposite direction along the cam groove 2*e*. By this, the pump portion 3*a* repeats the expanded state (part (a) of FIG. 11) and the contracted state (part (b) of FIG. 11) alternately, thus changing the volume of the developer supply container 1.

<Set Conditions of Drive Converting Mechanism>

In this example, the drive converting mechanism effects the drive conversion such that an amount (per unit time) of developer feeding to the discharging portion 4*c* by the rotation of the cylindrical portion 2*k* is larger than a discharging amount (per unit time) to the developer replenishing apparatus 201 from the discharging portion 4*c* by the function of the pump portion.

This is because if the developer discharging power of the pump portion 2*b* is higher than the developer feeding power of the feeding projection 2*c* to the discharging portion 3*h*, the amount of the developer existing in the discharging portion 3*h* gradually decreases. In other words, it is avoided that the time period required for supplying the developer from the developer supply container 1 to the developer replenishing apparatus 201 is prolonged.

In addition, in the drive converting mechanism of this embodiment, the drive conversion is such that the pump portion 3*a* reciprocates a plurality of times per one full rotation of the cylindrical portion 2*k*. This is for the following reasons.

In the case of the structure in which the cylindrical portion 2*k* is rotated inside the developer replenishing apparatus 201, it is preferable that the driving motor 500 is set at an output required to rotate the cylindrical portion 2*k* stably at all times. However, from the standpoint of reducing the energy consumption in the image forming apparatus 100 as much as possible, it is preferable to minimize the output of the driving motor 500. The output required by the driving motor 500 is calculated from the rotational torque and the rotational frequency of the cylindrical portion 2*k*, and therefore, in order to reduce the output of the driving motor 500, the rotational frequency of the cylindrical portion 2*k* is minimized.

However, in the case of this embodiment, if the rotational frequency of the cylindrical portion 2*k* is reduced, a number of operations of the pump portion 3*a* per unit time decreases, and therefore, the amount of the developer (per unit time) discharged from the developer supply container 1 decreases. In other words, there is a possibility that the developer amount discharged from the developer supply container 1 is insufficient to quickly meet the developer supply amount required by the main assembly of the image forming apparatus 100.

If the amount of the volume change of the pump portion 3*a* is increased, the developer discharging amount per unit cyclic period of the pump portion 3*a* can be increased, and therefore, the requirement of the main assembly of the image forming apparatus 100 can be met, but doing so gives rise to the following problem.

If the amount of the volume change of the pump portion 2*b* is increased, a peak value of the internal pressure (positive pressure) of the developer supply container 1 in the discharging step increases, and therefore, the load required for the reciprocation of the pump portion 2*b* increases.

For this reason, in this embodiment, the pump portion 3*a* operates a plurality of cyclic periods per one full rotation of the cylindrical portion 2*k*. By this, the developer discharge amount per unit time can be increased as compared with the case in which the pump portion 3*a* operates one cyclic period per one full rotation of the cylindrical portion 2*k*, without increasing the volume change amount of the pump portion 3*a*. Corresponding to the increase of the discharge amount of the developer, the rotational frequency of the cylindrical portion 2*k* can be reduced.

With the structure of this embodiment, the required output of the driving motor 500 may be low, and therefore, the energy consumption of the main assembly of the image forming apparatus 100 can be reduced. In this embodiment, the pump portion 3*a* operates two cycles per one full rotation of the cylindrical portion 2*k*.

<Position of Drive Converting Mechanism>

As shown in FIG. 11, in this embodiment, the drive converting mechanism (cam mechanism constituted by the reciprocation member engaging projection 3*c* and cam groove 2*e*) is provided outside of developer accommodating portion 2. More particularly, the drive converting mechanism is disposed at a position separated from the inside spaces of the cylindrical portion 2*k*, the pump portion 3*a*, and the discharging portion 4*c*, so that the drive converting mechanism does not contact the developer accommodated inside the cylindrical portion 2*k*, the pump portion 3, and the discharging portion 4.

By this, a problem which may arise when the drive converting mechanism is provided in the inside space of the developer accommodating portion 2 can be avoided. More particularly, the problem is that by the developer entering portions of the drive converting mechanism where sliding motions occur, the particles of the developer are subjected to heat and pressure to soften and therefore, they agglomerate into masses (coarse particle), or they enter into a converting mechanism with the result of torque increase. The problem can be avoided.

Now, the description will be made as to the developer supplying step into the developer supplying apparatus 201 by the developer supply container 1.

<Developer Supplying Step>

Figure 12:
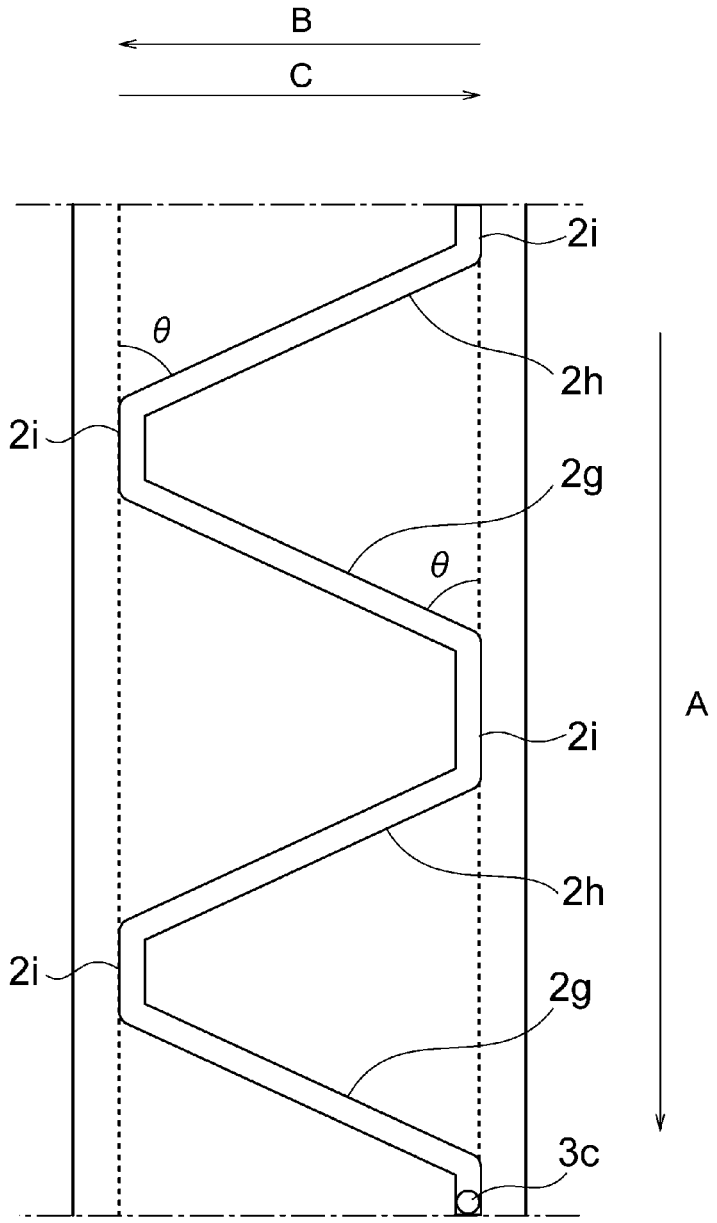
FIG. 12 illustrates a drive converting mechanism usable in an embodiment of the present invention.

Referring to FIGS. 11 and 12, a developer supplying step by the pump portion 3*a* will be described. FIG. 12 is an extended elevation illustrating a cam groove 21, in the above-described drive converting mechanism (cam mechanism including the reciprocating member engaging projection 3*c* and the cam groove 2*e*).

In this embodiment, the drive converting mechanism converts the rotational force to the reciprocation force. By this, as will be described hereinafter, the suction step by the pump operation (sucking operation through discharge opening 4*a*), the discharging step (discharging operation through the discharge opening 4*a*) and the rest step by the non-operation of the pump portion (neither suction nor discharging is effected through the discharge opening 4*a*) are repeated alternately. The suction step, the discharging step and the rest step will be described.

<Suction Stroke>

First, the suction step (sucking operation through discharge opening 4*a*) will be described.

As shown in FIG. 11, the sucking operation is effected by the pump portion 3*a* being changed from the most contracted state (minimum volume state) (part (b) of FIG. 11) to the most expanded state (maximum volume state) (part (a) of FIG. 11) by the above-described drive converting mechanism (cam mechanism).

At this time, the developer supply container 1 is substantially hermetically sealed except for the second discharge opening 4*a*, and the discharge opening 3*a* is plugged substantially by the developer T. Therefore, the internal pressure of the developer supply container 1 decreases with the increase of the inner volume of the developer supply container 1.

At this time, the internal pressure of the developer supply container 1 (the local internal pressure in the pump portion 3*a* and the neighborhood of the developer storage portion 4*d* (FIG. 7) in this embodiment) becomes lower than the ambient pressure (external air pressure). For this reason, the air outside the developer supply container 1 enters the developer supply container 1 through the discharge opening 4*a* by a pressure difference between the inside and the outside of the developer supply container 1.

At this time, the air is taken-in from the outside of the developer supply container 1 through the second discharge opening 4*a*, and therefore, the developer in the developer storage portion 4*d* above the second discharge opening 4*a* can be loosened (fluidized). More particularly, the air is impregnated into the developer powder existing in the developer storage portion 4*d*, thus reducing the bulk density of the developer powder and fluidizing the developer powder.

Therefore, even if the developer in the developer storage portion 4*d* is compacted by the vibration or the like during the transportation, the developer can be assuredly fluidized. Since the air is taken into the developer supply container 1 through the discharge opening 4*a*, the internal pressure of the developer supply container 1 changes in the neighborhood of the ambient pressure (external air pressure) despite the increase of the volume of the developer supply container 1.

In this manner, by the fluidization of the developer, the developer does not clog in the discharge opening 4*a*, so that the developer can be smoothly discharged through the discharge opening 4*a* in the discharging operation which will be described hereinafter. Therefore, the amount of the developer T (per unit time) discharged through the discharge opening 4*a* can be maintained substantially at a constant level for a long term.

The transportation is a normal transportation with a normal transportation distance and a normal transportation ambient condition. In the case that the transportation distance is unexpectedly longer than the normal transport patient distance or that the transportation condition is not well controlled (under high temperature and high humidity or the like), the developer in the developer supply container 1 may be unexpectedly compacted. In order to fluidize the developer assuredly in such a case, it will be necessary to expand and contract the pump portion 3*a* a plurality of times. Generally, such an operation is carried out using a driving source provided in the main assembly of the image forming apparatus after the developer supply container 1 is exchanged. At this time, it may be necessary to interrupt the continuing printing or copying operation in order to assure the image quality. Therefore, the productivity may be decreased. According to this embodiment, the discharging controlling mechanism 15 (FIG. 9) is capable of loosening the developer by a less expanding-and-contracting operation of the pump portion 3*a* as compared with the conventional developer supply container 1. Thus, a satisfactory developer container can be provided in this respect.

<Discharging Stroke>

The discharging step (discharging operation through the discharge opening 4*a*) will be described. The operation of the discharging controlling mechanism for controlling the amount of the developer discharged in the discharging stroke will be described hereinafter.

The discharging operation is effected by the pump portion 3*a* being changed from the most expanded state (part (a) of FIG. 11) to the most contracted state (part (b) of FIG. 11). More specifically, the volume of the developer supply container 1 decreases by the discharging operation. At this time, the developer supply container 1 is substantially hermetically sealed except for the second discharge opening 4*a*, and the discharge opening 4*a* is plugged substantially by the developer T until the developer is discharged. Therefore, by compressing the pump portion 3*a*, the internal pressure in the developer supply container 1 increases.

At this time, the internal pressure in developer supply container 1 becomes higher than the ambient pressure (external air pressure), and therefore, the developer is discharged through the second discharge opening 4*a* by the pressure difference between the inside and outside of the developer supply container 1. Therefore, the developer in the developer storage portion 4*d* having been fluidized by the suction stroke can be stably discharged. In addition, the air in the developer supply container 1 is discharged together with the developer, and therefore, the internal pressure of the developer supply container 1 decreases.

<Operation Rest Step>

The rest stroke in which the pump portion 3*a* does not reciprocate will be described.

In this embodiment, as described hereinbefore, the operation of the driving motor 500 is controlled by the control device 600 on the basis of the results of the detection of the magnetometric sensor 800*c* and/or the developer sensor 10*d*. With such a structure, the amount of the developer discharged from the developer supply container 1 directly influences the toner content of the developer, and therefore, it is necessary to supply the amount of the developer required by the image forming apparatus from the developer supply container 1. At this time, in order to stabilize the amount of the developer discharged from the developer supply container 1, it is desirable that the amount of volume change at one time is constant.

If, for example, the cam groove 2*e* includes only the portions for the discharging stroke and the suction stroke, the motor actuation may stop at halfway of the discharging stroke or suction stroke. After the stop of the driving motor 500, the cylindrical portion 2*k* continues rotating by the inertia, by which the pump portion 3*a* continues reciprocating until the cylindrical portion 2*k* stops, during which the discharging stroke or the suction stroke continues. The distance through which the cylindrical portion 2*k* rotates by the inertia is dependent on the rotational speed of the cylindrical portion 2*k*. Further, the rotational speed of the cylindrical portion 2*k* is dependent on the torque applied to the driving motor 500. From this, the torque to the motor changes depending on the amount of the developer in the developer supply container 1, and the speed of the cylindrical portion 2*k* may also change, and therefore, it is difficult to stop the pump portion 3*a* at the same position.

In order to stop the pump portion 3*a* at the same position, a region in which the pump portion 3*a* does not reciprocate even during the rotation of the cylindrical portion 2*k* is required to be provided in the cam groove 2*e*. As shown in FIG. 12, the cam groove 2*e* of this embodiment includes a first cam groove 2*g* inclined by a predetermined angle θ relative to the rotational moving direction of the cylindrical portion 2*k* (arrow A direction) and a second cam groove 2*h* symmetrically inclined in the opposite side, and these cam grooves are alternately provided. When the reciprocation member engaging projection 3*c* is engaged with the rotating first cam groove 2*g*, the pump portion 3*a* expands in an arrow B direction (suction stroke), and when the reciprocation member engaging projection 3*c* is engaged with the second cam groove 2*h*, the pump portion 3*a* contracts in an arrow C direction (discharging stroke).

Furthermore, in this embodiment, there is provided a third cam groove 2*i* which connects the first cam groove 2 *g* and the second cam groove 2*h* with each other and which extend substantially in parallel with the rotational moving direction (arrow A direction). The cam groove 2*i* does not move the reciprocation member 3*b* even when the cylindrical portion 2*k* rotates. That is, in the operation rest step, the reciprocation member engaging projection 3*c* is engaged with the cam groove 2*i*.

<Change of Internal Pressure in Developer Supply Container and Discharge Amount in Comparison Example>.

Figure 13:
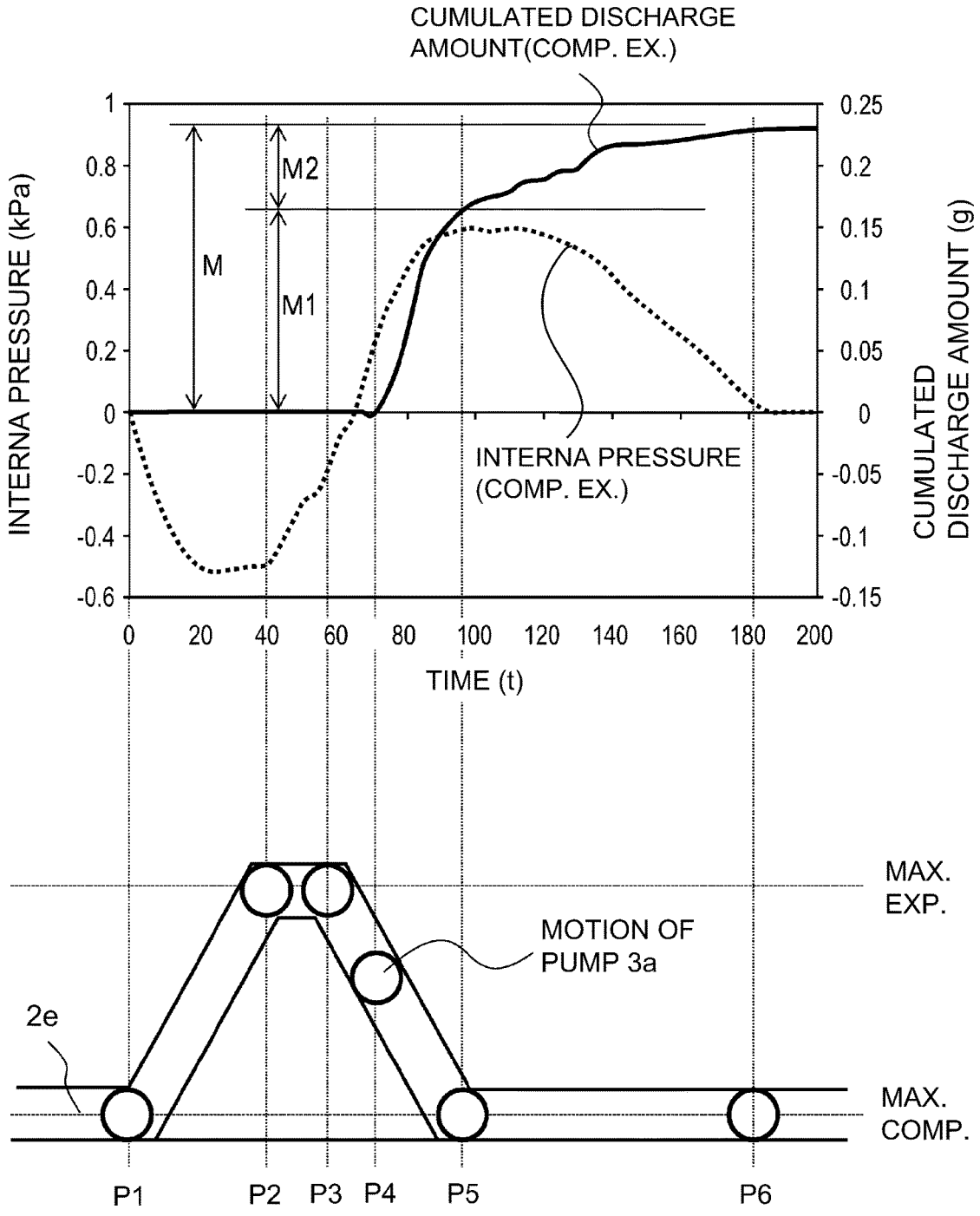
FIG. 13 shows an internal pressure of a container and a cumulative discharge amount of a developer supply container of a comparison example.

FIG. 13 shows the internal pressure Δ (pressure difference from the ambient pressure) in the developer supply container in one expanding-and-contracting operation cycle or period of the pump portion 3*a* and a cumulated value of the amount of the developer discharged from the developer supply container 1, in a comparison example not provided with the discharging controlling mechanism 15.

The abscissa of the graph of FIG. 13 is time, and the ordinate is the internal pressure Δ and the cumulative discharge amount of the developer. Below the graph, a schematic view of the cam groove 2*e* of the drive converting mechanism is shown with the position of the pump portion 3*a*. The one cycle of the expanding-and-contracting operation of the pump portion 3*a* proceeds in the direction from P1 to P6.

As described hereinbefore, when the pump portion 3*a* displaces from the maximum usable compression position P1 to the maximum usable expansion position P2, the internal pressure Δ of the developer supply container 1 changes to the negative pressure side. At this time, the developer is not discharged from the developer supply container 1. Then, when the pump portion 3*a* displaces from the maximum usable expanded position P3 to the maximum usable compressed position P5, the internal pressure Δ changes to the pressing side adjacent the position of the pump portion 3*a* indicated by P4 in the Figure. Thereafter, when the internal pressure Δ in developer supply container 1 starts to change to the pressing side, the developer starts to discharge from the developer supply container 1. Because the developer supply container 1 contains the developer, the presence of the developer functions as a discharge resistance with the result of short time lag.

Then, until the pump portion 3*a* reaches P5, the developer continues to discharge from the developer supply container 1. The cumulated value of the discharged developer is M1. In the change of the pump portion 3*a* from P5 to P6, the pump portion 3*a* keeps the position at the maximum usable compressed state (operation rest step).

However, as will be understood from FIG. 13, the internal pressure Δ of the container changes toward the pressing side even when the expanding-and-contracting operation of the pump portion 3*a* is not carried out. This is because it will take a certain period of time for the air taken into the developer supply container 1 by the elongating operation of the pump 3*a* to discharge together with the developer from the developer supply container 1 by the compressing operation of the pump portion 3*a*. Therefore, the pressing state continues after the stop of the expanding-and-contracting operation of the pump portion 3*a*, and therefore, the developer continues to discharge until the internal pressure Δ reaches the ambient pressure.

In this embodiment, the container internal pressure Δ after the expansion and contracting operation stop of the pump portion 3*a* is called "residual pressure", and the cumulated value of the developer discharged during this period is M2. Thus, the amount M of the developer discharged by one cycle of the expanding-and-contracting operation of the pump portion 3*a* of the developer supply container 1 is a sum of the amount (M1) of the developer discharged by the compressing operation of the pump portion 3*a* and the amount (M2) of the developer discharged by the residual pressure. Here, a percentage of M2 relative to the developer amount (M) is small, and therefore, the stable developer amount can be provided as a whole.

However, the amount M2 of the developer discharged by the residual pressure is not stabilized because of the current state of the developer and variation of the operation of the pump portion 3*a*. Therefore, when a further accurate discharge amount M from the developer supply container 1 is desired, it is desirable to control the developer amount M2.

<Operation of Discharging Controlling Mechanism>

In this embodiment, the discharging controlling mechanism 15 is provided to minimize the variation in the developer amount M2 resulting from the residual pressure. Referring to FIG. 14 through FIG. 17 and FIG. 19, the operation and the function of the discharging controlling mechanism 15 will be described. The positions of the pump portion 3*a* shown in FIG. 14 through FIG. 17 corresponds to the positions P1, P2 (P3), P5, P6 in FIG. 19.

Figure 16:
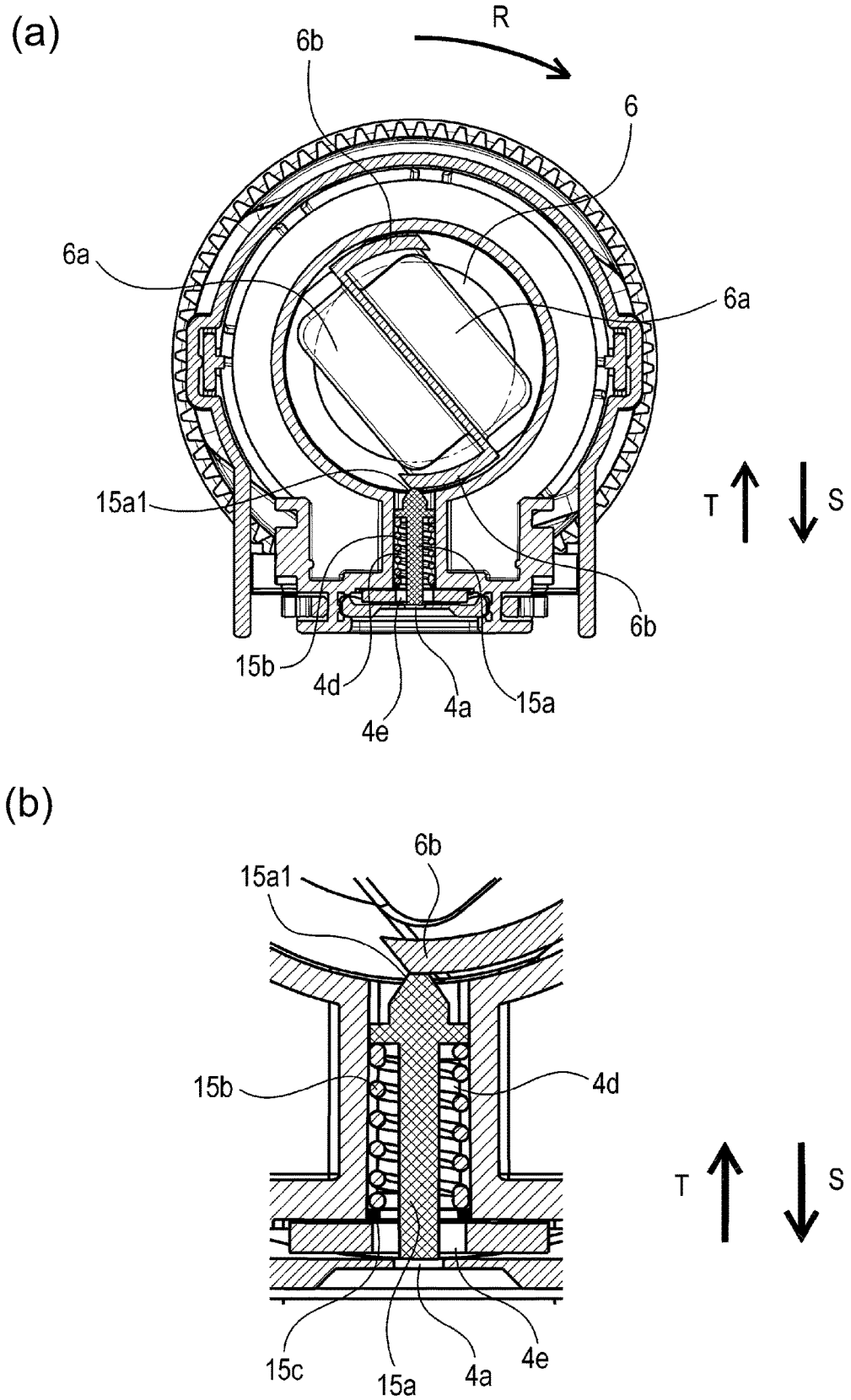
FIG. 16 shows the position halfway of the compressing operation of the pump portion, that is, the pump portion is between the most compressed position and the most expanded position, in the embodiment of the present invention.
Figure 17:
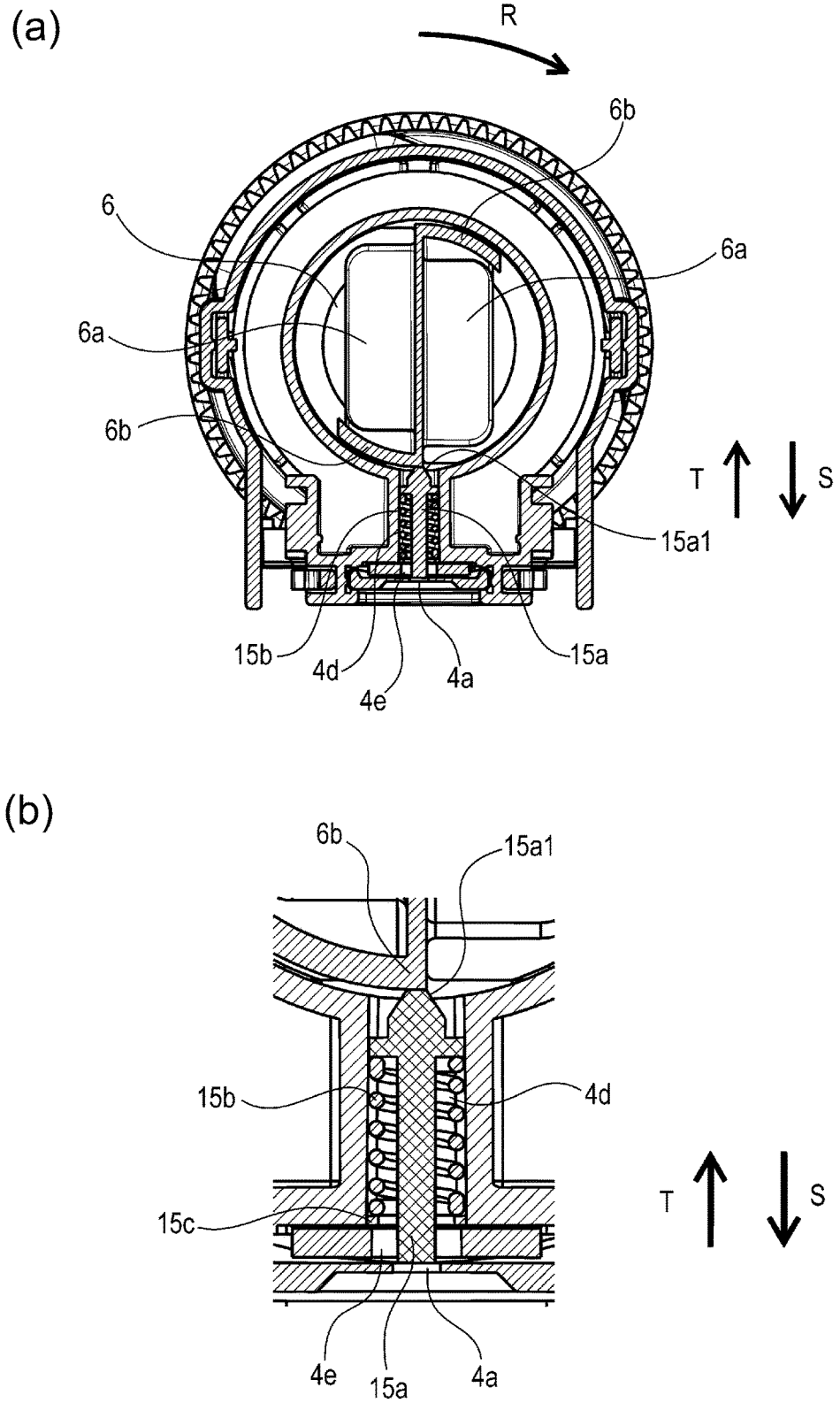
FIG. 17 shows a position at which the compressing operation of the pump portion ends, that is, the pump portion is in the most compressed state.
Figure 18:
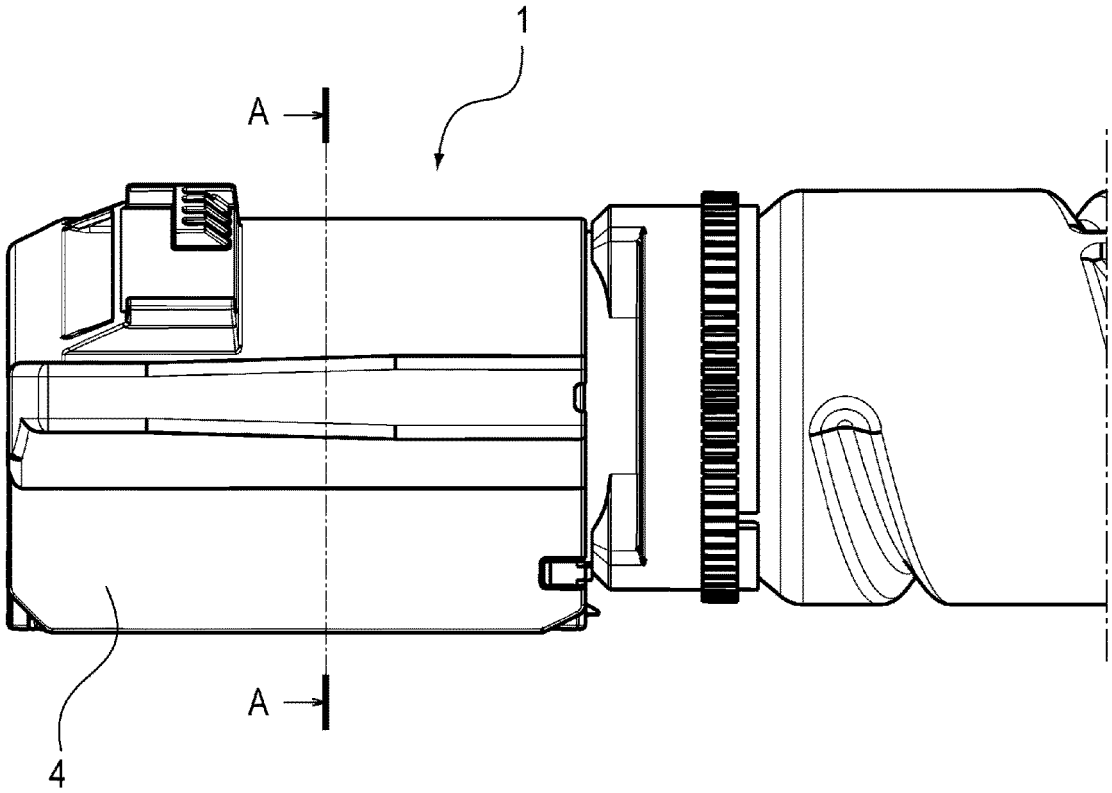
FIG. 18 illustrates a flange portion of the developer supply container usable with an embodiment of the present invention.

FIG. 14 through FIG. 17 are sectional views of the developer supply container 1 of FIG. 18 taken along a line and enlarged views of the neighborhood of the developer storage portion 4*d*, in one cycle of the expanding-and-contracting operation of the pump portion 3*a*.

Figure 19:
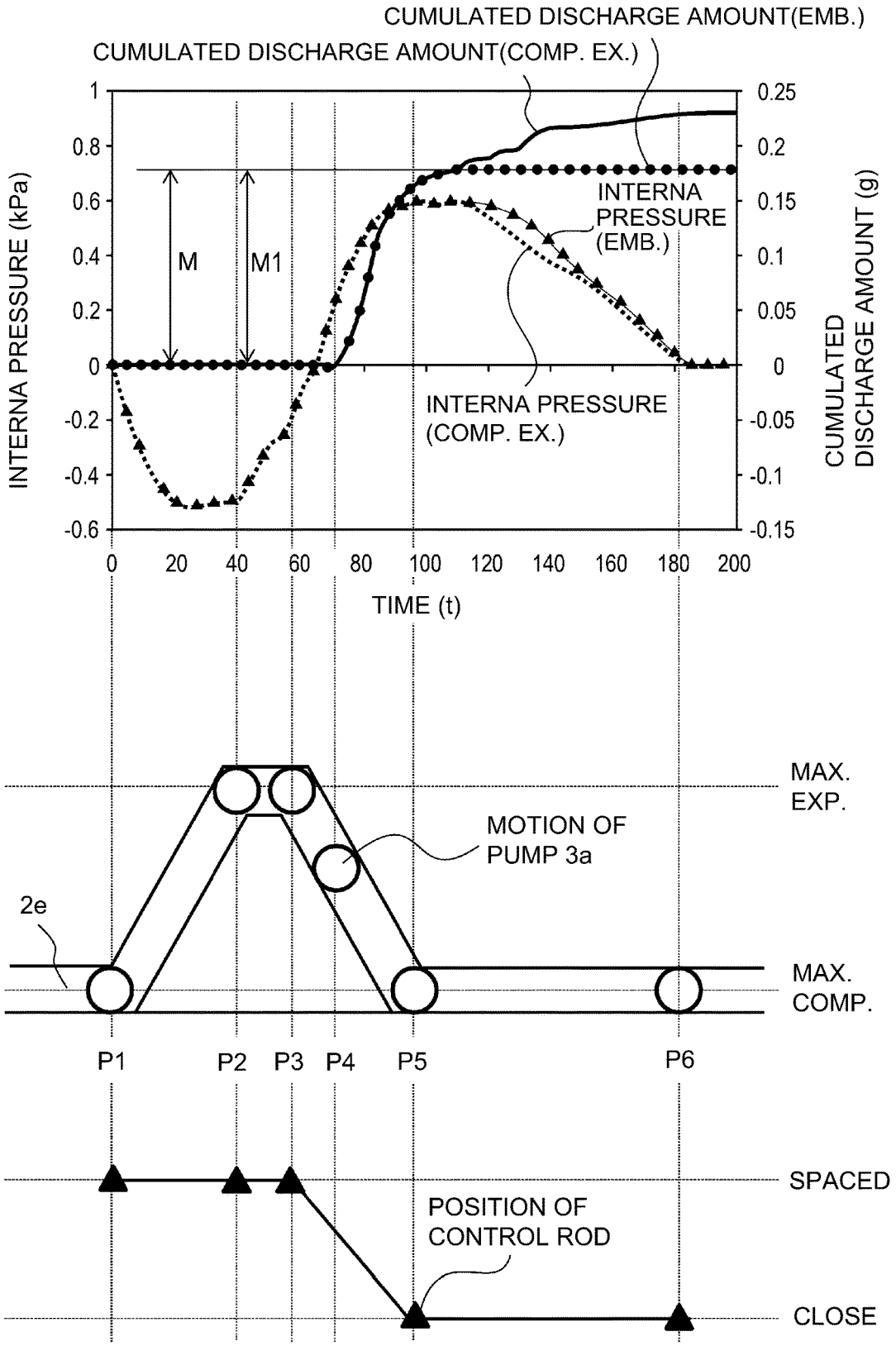
FIG. 19 shows an internal pressure of the container of the developer supply container and the cumulative discharge amount in the embodiment of the present invention.

FIG. 19 shows the internal pressure Δ (pressure difference relative to the ambient pressure) in the developer supply container and the cumulated value of the amount of the developer discharged from the developer supply container 1, in one cycle of the expanding-and-contracting operation of the pump portion 3*a*, in the developer supply container 1 of this embodiment. The abscissa of the graph of FIG. 19 is time, and the ordinate is the internal pressure Δ and the cumulative discharge amount of the developer, similarly to FIG. 13. Below the graph, a schematic view of the cam groove 2*e* of the drive converting mechanism is shown with the position of the pump portion 3*a*. In addition, the position of the control rod 15*a* relative to the second discharge opening 4*e* is schematically shown. The one cycle of the expanding-and-contracting operation of the pump portion 3*a* proceeds in the direction from P1 to P6.

Figure 14:
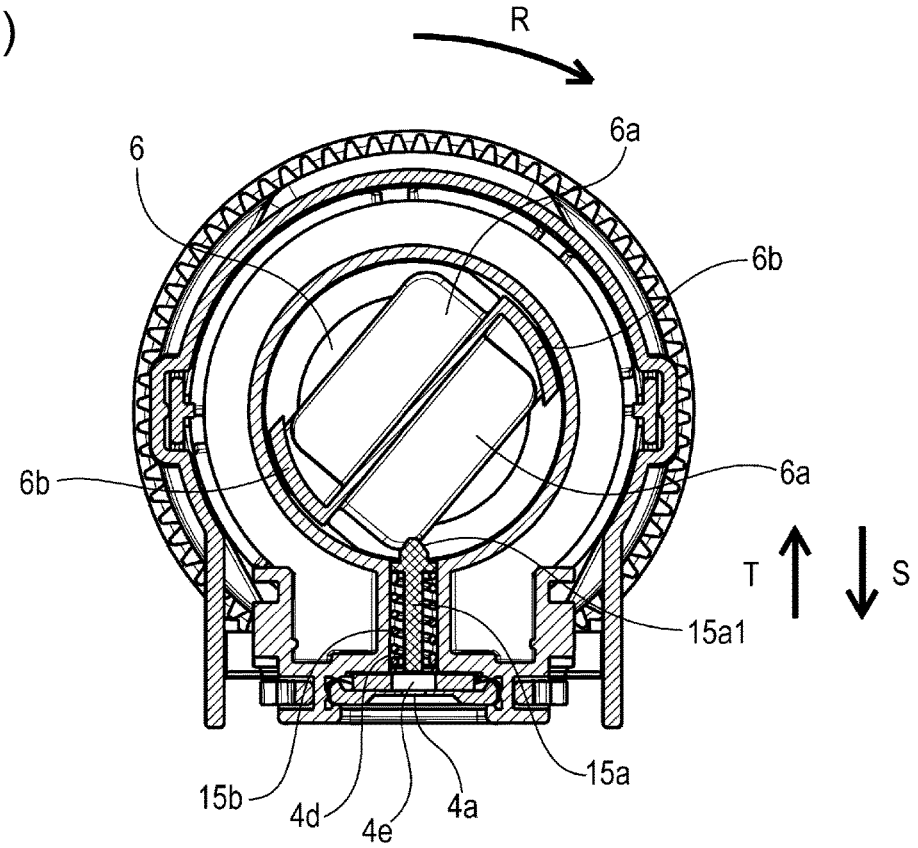
FIG. 14 shows a position at which the expansion stroke of a pump portion starts, that is, the pump portion is in the most compressed state.
Figure 14:
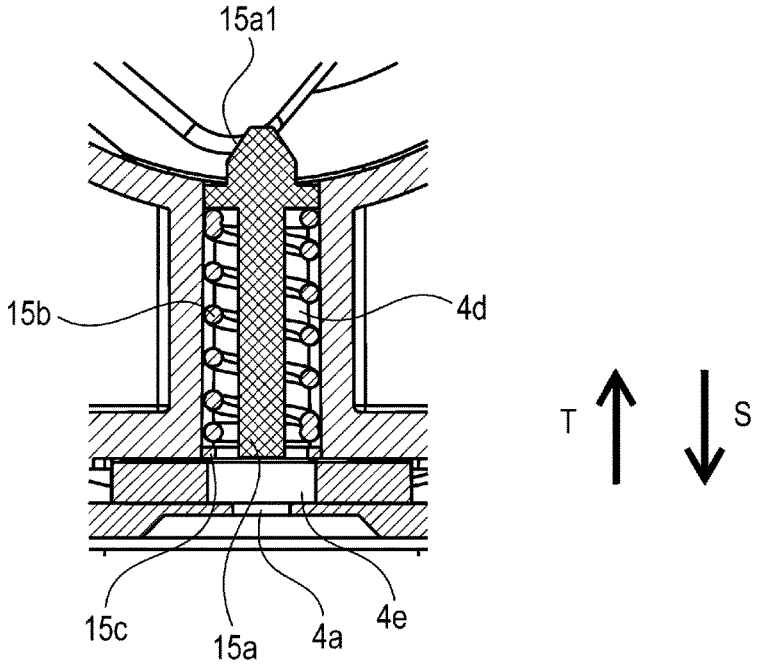

As shown in part (a) of FIG. 14, with the rotation of the cylindrical portion 2*k* (part (a) of FIG. 7) of the developer supply container 1, the feeding member 6 rotates in the direction of an arrow R to feed the developer into the developer storage portion 4*d* by the function of the inclination rib 6*a* of the feeding portion 6. At this time, as shown in FIG. 19, the pump portion 3*a* is in the maximum compressed position (P1). In addition, as shown in part (a) of FIG. 14, the pushing portion 6*b* of the feeding member 6 is not in contact with the engaging portion 15*a*1 at the free end of the discharging rod 15*a*. As shown in part (b) of FIG. 14, the control rod 15*a* disposed in the developer storage portion 4*d* is urged by the urging member 15*b* in the direction of the arrow T (upward). The engaging portion 15*a*1 is projected out of the developer storage portion 4*d*.

Subsequently, the feeding member 6 rotates in the direction of the arrow R with the rotation of the cylindrical portion 2*k* of the developer supply container 1 to the position indicated in part (a) of FIG. 15. At this time, as shown in FIG. 19, the pump portion 3*a* displaces from the maximum compressed position (P1) at which the volume is the minimum to the maximum elongated position (P2) at which the volume is the maximum. In addition, as shown in part (a) of FIG. 15, the pushing portion 6*b* of the feeding member 6 is not in contact with the engaging portion 15*a*1 at the free end of the discharging rod 15*a*. As shown in part (b) of FIG. 15, the control rod 15*a* disposed in the developer storage portion 4*d* is urged by the urging member 15*b* in the direction of the arrow T (upward). At the position indicated in FIG. 14 and FIG. 15, the developer is not discharged from the developer supply container 1, as will be understood from FIG. 19.

Figure 15:
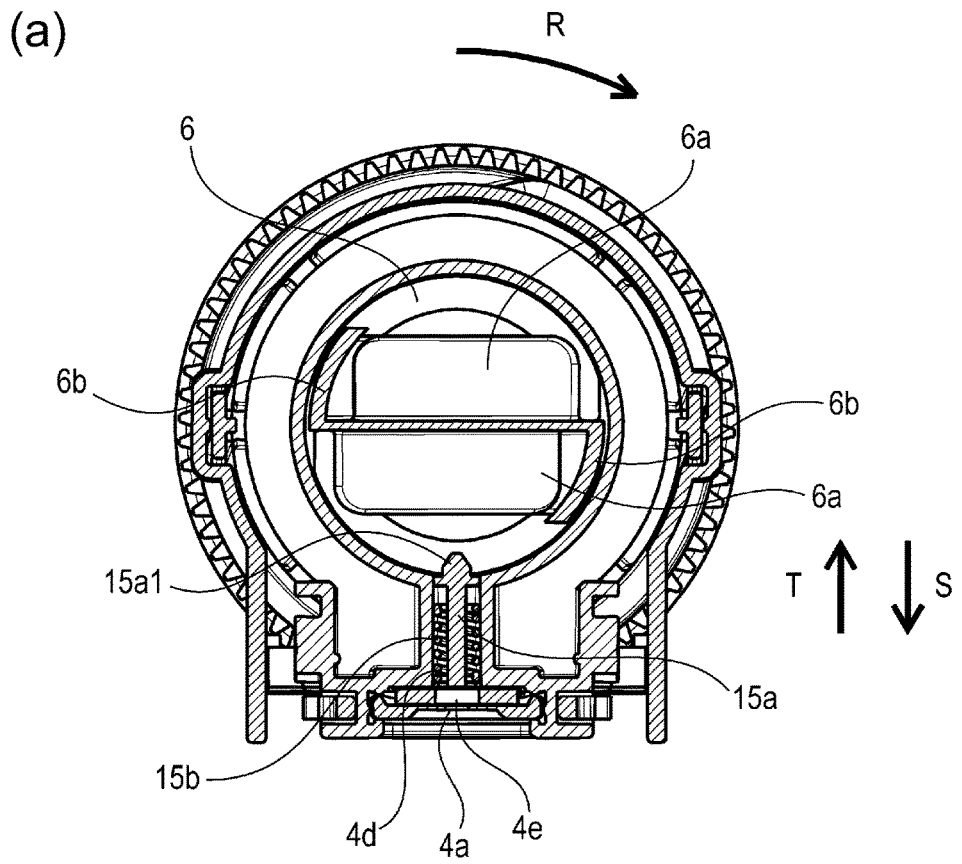
FIG. 15 shows a position at which the expansion stroke of the pump portion ends, that is, the pump portion is in the most expanded state, in the embodiment of the present invention.
Figure 15:
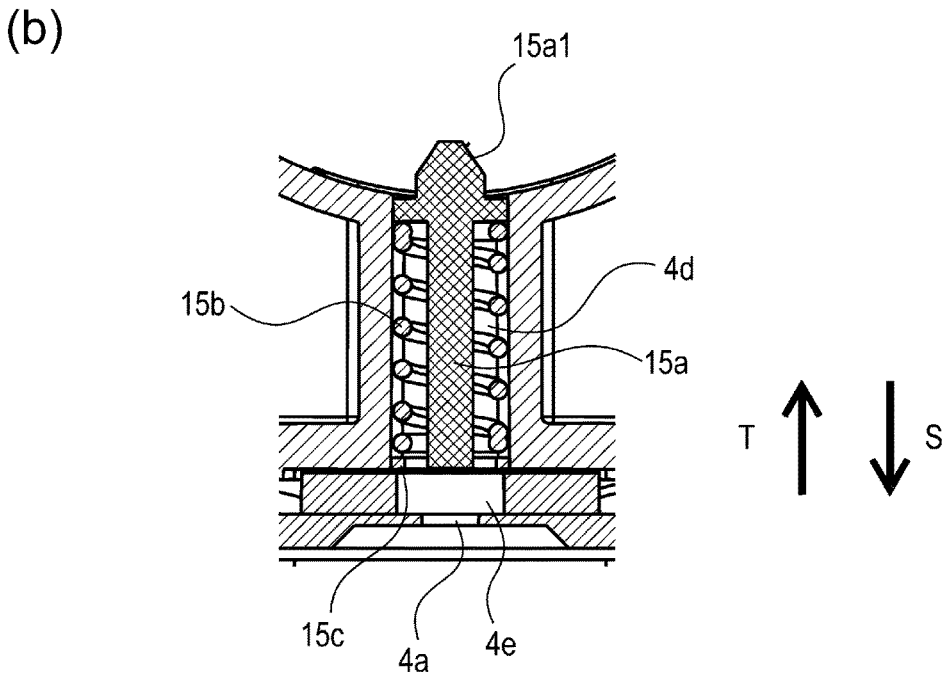

Furthermore, with the rotation of the cylindrical portion 2*k* of the developer supply container 1, the feeding member 6 rotates from the position of FIG. 15 to the position of FIG. 16. At this time, as shown in FIG. 19, the pump portion 3*a* displaces from the maximum expanded position (P3) at which the volume is the maximum to the maximum compressed position (P5) at which the volume is the minimum. As shown in part (b) of FIG. 16, when the pump portion 3*a* is in the maximum compressed position (P5), the pushing portion 6*b* of the feeding member 6 contacts the engaging portion 15*a*1 of the free end of the control rod 15*a* to displace the control rod 15*a* in the direction of the arrow S against the urging force of the urging member 15*b*. The free end portion of the control rod 15*a* opposite from the engaging portion 15*a*1 enters the first discharge opening 4*e* and is in the position adjacent to the second discharge opening 4*a*.

In the process of the movement of the pump portion 3*a* from the position (P3) shown in FIG. 15 to that of the position (P5) shown in FIG. 16, the amount M1 of the developer is discharged from the developer supply container 1, as will be understood from FIG. 19. The operation up to the stage is the same as that of the developer supply container 1 of the comparison example.

Thereafter, in the position shown in part (b) of FIG. 16, the control rod 15*a* becomes close to the second discharge opening 4*a*, so that the discharge of the developer through the second discharge opening 4*a* is prevented. That is, when the series of expanding-and-contracting operations of the pump portion 3*a* is completed, the control rod 15*a* narrows the discharging path of the second discharge opening 4*a*, and therefore, the discharge of the developer from the developer supply container 1 by the above-described residual pressure can be prevented. The residual pressure in the developer supply container 1 decreases by the discharge only of the air through a small gap between the control rod 15*a* and the second discharge opening 4*a*.

Then, with the rotation of the cylindrical portion 2*k* of the developer supply container 1, the feeding member 6 moves from the position of FIG. 16 to the position of FIG. 17. At this time, as shown in FIG. 19, the pump portion 3*a* keeps the maximum compressed position. In addition, as shown in FIG. 19, the container internal pressure is in the pressing side. As shown in part (b) of FIG. 17, the pushing portion 6*b* of the feeding member 6 contacts the engaging portion 15*a*1 formed at the free end of the control rod 15*a* to displace the control rod 15*a* in the direction of the arrow S against the urging force of the urging member 15*b*, thus maintaining the position of the control rod 15*a* close to the second discharge opening 4*a*.

Therefore, although the residual pressure tends to discharge the developer from the developer supply container 1, the control rod 15*a* narrows the discharging path of the second discharge opening 4*a*. Thus, the discharging of the developer from the developer supply container 1 can be prevented. In addition, similarly to the foregoing, the residual pressure in developer supply container 1 decreases by the discharge of the air only through the small gap between the control rod 15*a* and the second discharge opening 4*a*, so that the internal pressure in the developer supply container 1 becomes substantially equivalent to the ambient pressure.

That is, when the residual pressure exists in the developer supply container 1, the control rod 15*a* is close to the second discharge opening 4*a*. Therefore, discharge amount M of the developer from the developer supply container 1 it substantially equal to the developer amount M1 discharged during the expanding-and-contracting operation of the pump portion 3*a* (strictly, during the compressing operation).

In this manner, the discharge amount of the developer is smaller by the amount M2 than the discharge amount M discharged from the developer supply container in the comparison example not provided with the discharging controlling mechanism 15. Here, the developer amount M1 can be adjusted by controlling the expanding-and-contracting operation distance of the pump portion 3*a* and/or the size of the developer storage portion 4*d* to provide a desired developer supply amount M. That is, according to the developer supply container 1, the developer discharge amount M from the developer supply container 1 can be adjusted, so that the discharge amount accuracy can be improved.

Then, with the rotation of the cylindrical portion 2*k* of the developer supply container 1, the feeding member 6 moves from the position of FIG. 17 to the position of FIG. 14. At this time, as shown in part (a) of FIG. 14, the pushing portion 6*b* of the feeding member 6 is released from the engaging portion 15*a*1 provided at the free end of the control rod 15*a*. Therefore, the control rod 15*a* is urged in the direction indicated by the arrow T in the Figure by the urging force of the urging member 15*b*.

In the developer supply container 1 of this embodiment, the above-described series of operations can be carried out until absence the inside developer from the mounting of the developer supply container 1 in the image forming apparatus. In this embodiment, the timing at which the control rod 15*a* displaces to the second position close to the second discharge opening 4*a* has been described as being when the pump portion 3*a* is in the maximum compressed position (position of FIG. 16, 17). However, from the standpoint of controlling the discharge amount of the developer of the developer supply container 1, the timing can be properly set by one skilled in the art, depending on the situation.

For example, in the case that the discharge amount of the developer supply container 1 is desired to be small, the expansion and contraction distance of the pump 3*a* is decreased, or the volume of the developer storage portion 4*d* is decreased. Alternatively, the control rod 15*a* may be made closer to the second discharge opening 4*a* before the pump portion 3*a* is compressed to the maximum extent shown in FIG. 19 by P4, that is, before the volume of the pump portion 3*a* becomes minimum, for example. In such a case, the control rod 15*a* is kept in the second position which is close to the second discharge opening 4*a* when the pump portion 3*a* is in the range from the position P4 to the position P6.

Alternatively, the control rod 15*a* may be spaced from the second discharge opening 4*a* when the pump portion 3*a* is in a certain position between the position P5 to the position P6, because it is unnecessary that the control rod 15*a* is in the second position throughout the period between P5 and P6 of FIG. 19 when the pump portion 3*a* is in the maximum compressed state. That is, after the residual pressure is removed when the pump portion is in the maximum compressed position, the control rod 15*a* is not required to be in the second position close to the second discharge opening 4*a*. Therefore, it will suffice if the control rod 15*a* is in the second position at least for a predetermined period in which the residual pressure exists when the pump portion 3*a* is in the maximum compressed position.

It can be selected by the length of the pushing portion 6*b* as to at which position the control rod 15*a* is moved to the second position or how long the control rod 15*a* is in the second position in the compression stroke of the pump portion 3*a*.

As described in the foregoing, in the developer supply container 1 of the embodiment, the inside developer may be compacted immediately after the developer supply container 1 is mounted in the image forming apparatus, due to the transport operation or long-term non-use state. However, as described hereinbefore, with the rotation of the cylindrical portion 2*k*, the control rod 15*a* reciprocates in the directions of the arrow S and arrow T in the developer storage portion 4*d*, and therefore, the compacted developer can be easily loosened.

In addition, during the expanding stroke of the pump portion 3*a*, the control rod 15*a* is spaced from the second discharge opening 4*a*, and substantially when the compressing operation of the pump portion 3*a* is finished, the control rod 15*a* is in the position close to the second discharge opening 4*a*, and therefore, the discharge of the developer due to the residual pressure can be prevented. Accordingly, the developer can be stably discharged from the developer supply container 1, and in addition, the discharge amount of the developer can be controlled as desired, so that the accurate discharge amount can be accomplished.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-167525 filed on Aug. 27, 2015, which is hereby incorporated by reference herein in its entirety.

What is claimed is:

1. A developer supply container comprising:

a developer accommodating portion capable of accommodating a developer;

a storage portion capable of storing the developer, said storage portion being provided with a discharge opening configured to permit discharge of the developer from said storage portion;

a pump portion changeable between a maximum volume state and a minimum volume state and actable to said discharge opening;

a driving force transmitting portion capable of transmitting a force for expanding and contracting said pump portion;

a discharge suppressing portion, provided in said storage portion, movable between a first position in which said discharge suppressing portion opens said discharge opening and a second position in which said discharge suppressing portion substantially closes said discharge opening; and a switching portion capable of switching in interrelation with said driving force transmitting portion to switch said discharge suppressing portion from the first position to the second position before the volume of said pump portion starts to increase after said pump portion reaches the minimum volume state.

2. A developer supply container according to claim 1, further comprising a holding portion configured to hold said pump portion, wherein said discharge opening and said discharge suppressing portion are provided in said holding portion, and said developer accommodating portion is rotatable relative to said holding portion, and wherein the volume of said pump portion is changeable with rotation of said developer accommodating portion.

3. A developer supply container according to claim 2, wherein said driving force transmitting portion moves in interrelation with the rotation of said developer accommodating portion, and said switching portion rotates in interrelation with the rotation of said developer accommodating portion.

4. A developer supply container according to claim 3, wherein said switching portion is in contact with said discharge suppressing portion when said pump portion is in the minimum volume state and is not in contact with said discharge suppressing portion when said pump portion is in the maximum value state.

5. A developer supply container according to claim 3, wherein said regulating portion moves said discharge suppressing portion to the second position before said pump portion reaches the minimum volume state.

6. A developer supply container according to claim 3, wherein said switching portion is provided on a feeding member which is rotatable integrally with said developer accommodating portion and which is capable of feeding the developer in said developer accommodating portion to said discharge opening.

7. A developer supply container according to claim 1, further comprising an urging member for urging said discharge suppressing portion in a direction from the second position for the first position.

8. An image forming system comprising a developer supply container and a developer supplying device to which developer supply container is detachably mountable, said developer supplying device including, a mounting portion configured to dismountably mount said developer supply container; and a developer receiving portion for receiving a developer from said developer supply container, said developer supply container including, a developer accommodating portion capable of accommodating a developer;

a storage portion capable of storing the developer;

said storage portion being provided with a discharge opening configured to permit discharge of the developer from said storage portion to said developer receiving portion;

a pump portion changeable between a maximum volume state and a minimum volume state and actable to said discharge opening;

a driving force transmitting portion capable of transmitting a force for expanding and contracting said pump portion;

a discharge suppressing portion, provided in said storage portion, movable between a first position in which said discharge suppressing portion opens said discharge opening and a second position in which said discharge suppressing portion substantially closes said discharge opening, and a switching portion capable of switching in interrelation with said driving force transmitting portion to switch said discharge suppressing portion from the first position to the second position before the volume of said pump portion starts to increase after said pump portion reaches the minimum volume state.

9. A system according to claim 8, further comprising a holder portion configured to said hold pump portion, wherein said discharge opening and said discharge suppressing portion are provided in said holding portion, and said developer accommodating portion is rotatable relative to said holding portion, and wherein the volume of said pump portion is changeable with rotation of said developer accommodating portion.

10. A system according to claim 9, wherein said driving force transmitting portion moves in interrelation with the rotation of said developer accommodating portion, and said switching portion rotates in interrelation with the rotation of said developer accommodating portion.

11. A system according to claim 10, wherein said switching portion is in contact with said discharge suppressing portion when said pump portion is in the minimum volume state and is not in contact with said discharge suppressing portion when said pump portion is in the maximum volume state.

12. A system according to claim 10, wherein said regulating portion moves said discharge suppressing portion to the second position before said pump portion reaches the minimum volume state.

13. A system according to claim 10, wherein said switching portion is provided on a feeding member which is rotatable integrally with said developer accommodating portion and which is capable of feeding the developer in said developer accommodating portion to said discharge opening.

14. A system according to claim 8, further comprising an urging member for urging said discharge suppressing portion in a direction from the second position to the first position.

* * * * *